US006188366B1

(12) United States Patent
Yamamoto et al.

(10) Patent No.: US 6,188,366 B1
(45) Date of Patent: Feb. 13, 2001

(54) MONOPOLE ANTENNA

(75) Inventors: Atsushi Yamamoto; Toshimitsu Matsuyoshi; Koichi Ogawa, all of Osaka (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/324,334

(22) Filed: Jun. 2, 1999

(30) Foreign Application Priority Data

Jun. 4, 1998 (JP) ..... 10-156209
Oct. 21, 1998 (JP) ..... 10-299546

(51) Int. Cl.[7] ..... H01Q 1/00; H01Q 9/00

(52) U.S. Cl. ..... 343/722; 343/752

(58) Field of Search ..... 343/722, 749, 343/750, 752, 829, 830, 846

(56) References Cited

U.S. PATENT DOCUMENTS 3,838,429 * 9/1974 Reggia ..... 343/750
5,706,016 * 1/1998 Harrison, II ..... 343/752

FOREIGN PATENT DOCUMENTS 8-186420 7/1996 (JP) .

* cited by examiner

*Primary Examiner*—Tan Ho
(74) *Attorney, Agent, or Firm*—Merchant & Gould P.C.

(57) ABSTRACT

A disk-shaped conductor 22, a ring-shaped conductor 24 and a ring-shaped conductor 26 are arranged in that order on the same plane. One end of a linear conductor 21 is connected perpendicularly to the center of the disk-shaped conductor 22, and the outer edge of the disk-shaped conductor 22 is connected to the inner edge of the ring-shaped conductor 24 via an anti-resonance circuit 23. Moreover, the outer edge of the ring-shaped conductor 24 is connected to the inner edge of the ring-shaped conductor 26 via an anti-resonance circuit 25. Due to the anti-resonance circuits 23 and 25, electrical blocking can be attained, so that an electromagnetic wave of a first frequency f1 is excited by the system extending from the linear conductor 21 to the disk-shaped conductor 22, an electromagnetic wave of a second frequency f2 is excited by the system extending from the linear conductor 21 to the ring-shaped conductor 24, and an electromagnetic wave of a third frequency f3 is excited by the system extending from the linear conductor 21 to the ring-shaped conductor 26. Thus, a small monopole antenna can be attained that has a simple structure and can be operated at a plurality of frequencies.

31 Claims, 20 Drawing Sheets impedance characteristics (VSWR)

radiation characteristics

● characteristics of conventional single-frequency monopole antennas

● characteristics of multi-frequency monopole antenna

MONOPOLE ANTENNA

FIELD OF THE INVENTION

This invention relates to a monopole antenna mainly used for mobile communications, and in particular, to a monopole antenna that is suitable as an antenna for a base station.

BACKGROUND OF THE INVENTION

FIG. 20 shows a conventional monopole antenna comprising one antenna element, which excites electromagnetic waves at two frequencies. In FIG. 20, numeral 91 denotes a disk-shaped earth conductor, numeral 92 denotes a current supply portion located at the center of the earth conductor 91, and numeral 93 is an antenna element made of a linear conductor. The antenna element 93 has a coil 93*a* at its center, and one end of the antenna element 93 is electrically connected to the current supply portion 92 located at the center of the earth conductor 91 so that it stands perpendicularly on the earth conductor 91.

In the antenna element 93, electromagnetic waves with lower frequency are excited in the entire antenna element, and due to the central coil 93*a,* electromagnetic waves with the same phase but higher frequency are excited above and below the coil 93*a*. Thus, a two-frequency monopole antenna oscillating at different frequencies can be obtained.

However, in this conventional monopole antenna, the height of the antenna element 93 has to be at least ¼ of the wavelength at the lower excitation frequency or at least ¾ of the wavelength at the higher excitation frequency, so that the antenna element 93 becomes relatively tall and miniaturization becomes difficult. Moreover, it is structurally impossible to excite electromagnetic waves whose frequencies are close to each other, so that the frequencies that can be excited are limited. In practice, operation of up to two frequencies is possible.

Furthermore, if this conventional monopole antenna is installed, for example, at the ceiling of a room, it is preferable that the antenna is installed head-down facing the floor, so that the antenna element 93 faces the space into which the electromagnetic waves are being radiated, in order to improve the radiation efficiency of the antenna. In this case, it is preferable that there are no objects hindering the transmission between the antenna element 93 and the radiation space, and that visual contact can be established between the antenna element 93 and the entire radiation space. Moreover, there is a need for monopole antennas that can be installed in a manner so that they can hardly be noticed, but if a conventional monopole antenna with an antenna element 93 protruding from the ceiling is used, its optical appearance is unpleasant, because the antenna element 93 is relatively tall.

SUMMARY OF THE INVENTION

It is an object of the present invention to solve these problems of the prior art and provide a monopole antenna that has a simple configuration, can be operated at a plurality of frequencies, and is small.

A monopole antenna in accordance with the present invention comprises an earth conductor, a current supply portion located on a surface of the earth conductor, a linear conductor having a first end connected to the current supply portion and a second end, a planar conductor that is connected to the second end of the linear conductor, and a ring-shaped conductor whose inner edge is connected to an outer edge of the planar conductor via an anti-resonance circuit. According to this first configuration of a monopole antenna, by setting the resonance frequency of the anti-resonance circuit to $f_1$, the impedance of the anti-resonance circuit at the frequency $f_1$ becomes high, and the planar conductor and the ring-shaped conductor are electrically blocked from each other, so that the system comprising the linear conductor and the planar conductor can be excited at the first frequency $f_1$, and the system extending from the linear conductor to the ring-shaped conductor can be excited at a second frequency $f_2$. If the planar conductor is connected perpendicularly to the linear conductor, and the ring-shaped conductor is arranged in the same plane as the planar conductor, the height of the portion of the antenna that includes the linear conductor, the planar conductor and the ring-shaped conductor can be reduced. Consequently, with this first configuration of a monopole antenna, a compact monopole antenna with simple configuration that can be operated at a plurality of frequencies can be obtained.

It is preferable that the monopole antenna according to this first configuration further comprises an earth wire that connects at least one of the planar conductor and the ring-shaped conductor to the earth conductor. With this configuration, the input impedance of the antenna can be raised at each operating frequency. As a result, the impedance matching between the antenna input impedance and the current supply portion can be improved for every operation frequency, which improves the characteristics of the antenna.

In the monopole antenna according to this first configuration, the planar conductor and the ring-shape conductor can be arranged in one plane, or in different planes.

It is preferable that in the monopole antenna according to this first configuration, the ring-shape conductor comprises a plurality of ring-shaped conductors, and that opposing inner edges and outer edges of adjacent ring-shaped conductors are connected via an anti-resonance circuit. With this configuration, it is possible to obtain a monopole antenna that can be operated at three or more operating frequencies. In this case, it is preferable that the monopole antenna further comprises an earth wire that connects at least one of the planar conductor and the plurality of ring-shaped conductors to the earth conductor. In some cases, the impedance matching with a ring-shaped conductor is sufficient, and in these cases, it is not necessary to match it with a earth wire. Especially, the impedance matching of the innermost planar conductor or ring-shaped conductor is sometimes sufficient. Also in this case, the planar conductor and the plurality of ring-shape conductors can be arranged in one plane, or in different planes.

It is preferable that in the monopole antenna according to this first configuration, the planar conductor is a disk-shaped conductor. In this case, it is preferable that the current supply portion is arranged at the center of the surface of the earth conductor, and the first end of the linear conductor is connected to the current supply portion so that the linear conductor is perpendicular to the earth conductor, the second end of the linear conductor is connected to the center of the planar conductor so that the linear conductor is perpendicular to the planar conductor, and the ring-shape conductor is arranged concentrically around the planar conductor.

It is preferable that in the monopole antenna according to this first configuration, the anti-resonance circuit is a parallel circuit comprising a coil and a capacitor.

It is also preferable that in the monopole antenna according to this first configuration, the anti-resonance circuit consists only of a coil. With this configuration, the number of parts can be reduced.

It is preferable that in the monopole antenna according to this first configuration, the planar conductor, the anti-resonance circuit, and the ring-shaped conductor are patterned on a dielectric substrate. With this configuration, electrical blocking at the desired frequencies is possible by adjusting the pattern of the anti-resonance circuit.

It is preferable that the monopole antenna according to this first configuration further comprises a reflection conductor arranged on a side of the earth conductor opposite the side on which the planar conductor is arranged, in a manner that the reflection conductor is electrically coupled to the earth conductor through a space between the two. With this configuration, the following effects can be achieved. Because an electric current flows also in the reflection conductor due to the electrical coupling through space, an electromagnetic wave is radiated also from the edge of the reflection conductor. Consequently, the radiation of electromagnetic waves from this monopole antenna corresponds to the sum of the radiation from the earth conductor, the radiation from the antenna defined by the linear conductor, the planar conductor and the ring-shaped conductor, and the radiation from the reflection conductor, and the directivity of the monopole antenna can be changed by adjusting the size of the earth conductor and the reflection conductor, or the distance between the earth conductor and the reflection conductor. In this case, it is preferable that the reflection conductor is electrically connected to the earth conductor. With this configuration, the following effects can be attained. The reflection conductor, which is electrically connected to the earth conductor, does not only serve as a reflection conductor, but also serves electrically as an earth conductor, which suppresses current leaks from the current supply portion, so that the input impedance of the antenna can be stabilized. Furthermore, in this case, it is preferable that the reflection conductor comprises a plurality of reflection conductors, wherein at least one of the plurality of reflection conductors is electrically connected to the earth conductor. Furthermore, in this case, it is preferable that the earth conductor and the reflection conductor have surfaces that face each other, and a surface area of the reflection conductor is greater than a surface area of the earth conductor. With this configuration, the spatial coupling between the earth conductor and the reflection conductor is strengthened, which improves the efficiency with which radiation from the reflection conductor is carried out.

A monopole antenna in accordance with a second configuration of the present invention comprises an earth conductor, a current supply portion located on a surface of the earth conductor, a linear conductor having a first end connected to the current supply portion and a second end, and a ring-shaped conductor whose inner edge is connected to the second end of the linear conductor via an anti-resonance circuit.

It is preferable that the monopole antenna of this second configuration further comprises an earth wire that connects the ring-shaped conductor to the earth conductor.

It is preferable that in the monopole antenna of this second configuration, the ring-shape conductor comprises a plurality of ring-shaped conductors, wherein opposing inner edges and outer edges of adjacent ring-shaped conductors are connected via an anti-resonance circuit. In this case, it is preferable that the monopole antenna further comprises an earth wire that connects at least one of the plurality of ring-shaped conductors to the earth conductor. Moreover, the plurality of ring-shape conductors can be arranged in one plane or at least one of the plurality of ring-shaped conductors can be arranged in a different plane. In this case, it is preferable that the current supply portion is located at a center of the surface of the earth conductor, and the plurality of ring-shaped conductors is arranged concentrically around the current supply portion.

It is preferable that in the monopole antenna of the second configuration, the anti-resonance circuit is a parallel circuit comprising a coil and a capacitor.

It is preferable that in the monopole antenna of the second configuration, the anti-resonance circuit consists only of a coil.

It is preferable that in the monopole antenna of the second configuration, the anti-resonance circuit and the ring-shaped conductor are patterned on a dielectric substrate.

It is preferable that the monopole antenna of the second configuration further comprises a reflection conductor arranged on a side of the earth conductor opposite the side on which a ring-shaped conductor is arranged, in a manner that the reflection conductor is electrically coupled to the earth conductor through a space between the two. In this case, it is preferable that the reflection conductor is electrically connected to the earth conductor. Moreover, it is preferable that the reflection conductor comprises a plurality of reflection conductors, wherein at least one of the plurality of reflection conductors is electrically connected to the earth conductor. Moreover, it is preferable that the earth conductor and the reflection conductor have surfaces that face each other, and a surface area of the reflection conductor is greater than a surface area of the earth conductor.

BRIEF EXPLANATION OF THE DRAWINGS

FIG. 5(*b*) is a schematic perspective view showing the antenna element of the monopole antenna in FIG. 5(*a*).

DESCRIPTION OF THE PREFERRED EMBODIMENTS

The following is an explanation of the present invention with reference to the drawings.

First Embodiment

A first embodiment of the present invention is explained with reference to FIGS. 1, 2 and 3.

Figure 1:
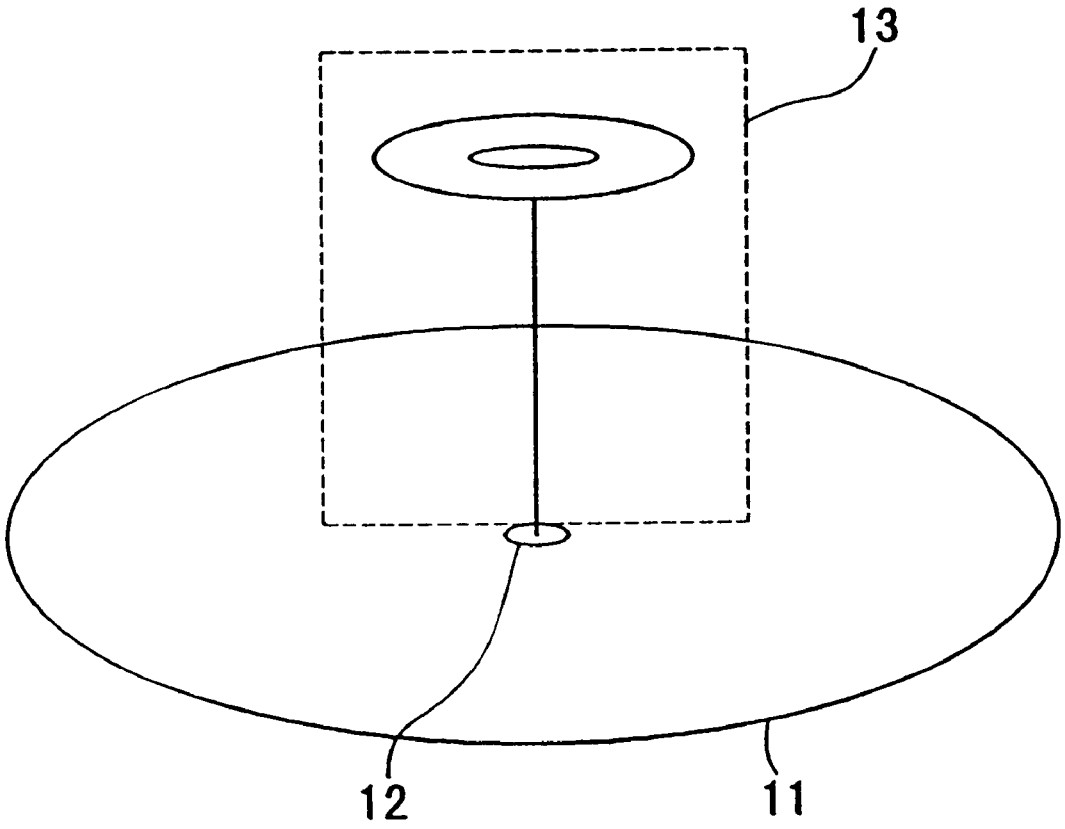
FIG. 1 is a schematic perspective view showing a monopole antenna according to an embodiment of the present invention.

FIG. 1 is a schematic perspective view showing a monopole antenna according to a first embodiment of the present invention. In FIG. 1, numeral 11 denotes a disk-shaped earth conductor, numeral 12 denotes a coaxial current supply portion (referred to as "current supply portion" in the following), located at the center of the earth conductor 11, and numeral 13 denotes an antenna element. The current supply portion 12 is located on the surface of the earth conductor 11, and the antenna element 13 is electrically connected to the current supply portion 12, and stands perpendicularly on the earth conductor 11.

Figure 2:
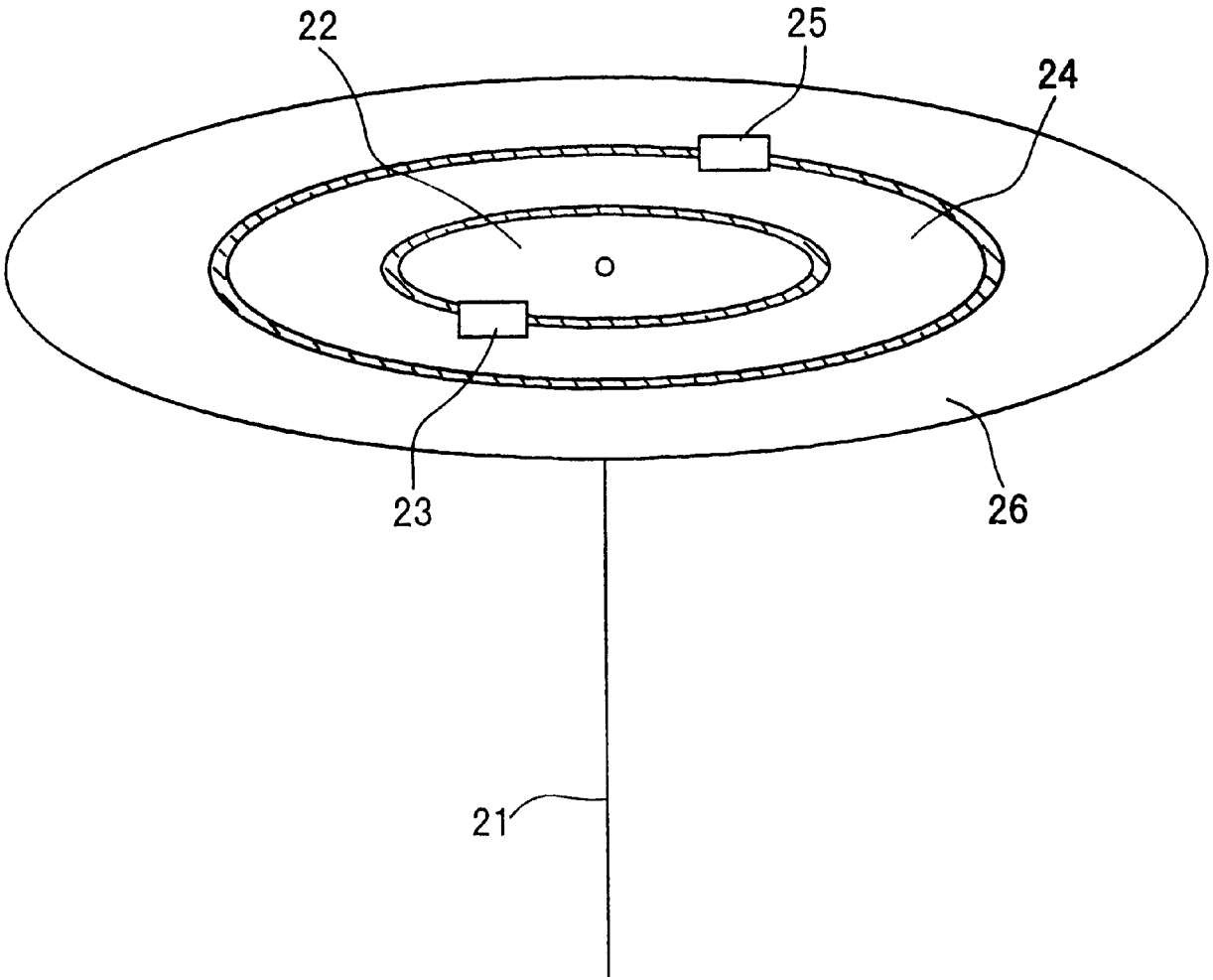
FIG. 2 is a schematic perspective view showing the antenna element in a first and a second embodiment of the present invention.

FIG. 2 is a schematic perspective view showing the antenna element in FIG. 1. As an example, this drawing shows a three-frequency monopole antenna. In FIG. 2, numeral 21 denotes a linear conductor, numeral 22 denotes a disk-shaped conductor, numeral 23 denotes an anti-resonance circuit, numeral 24 denotes a ring-shaped conductor, numeral 25 denotes an anti-resonance circuit, and numeral 26 denotes a ring-shaped conductor. The disk-shaped conductor 22, the ring-shaped conductor 24, and the ring-shaped conductor 26 are arranged on the same plane in concentric rings starting with the disk-shaped conductor 22 on the inside. The upper end of the linear conductor 21 is electrically connected perpendicularly to the center of the disk-shaped conductor 22. The outer edge of the disk-shaped conductor 22 is connected to the inner edge of the ring-shaped conductor 24 via the anti-resonance circuit 23. The outer edge of the ring-shaped conductor 24 is connected to the inner edge of the ring-shaped conductor 26 via the anti-resonance circuit 25.

Figure 3:
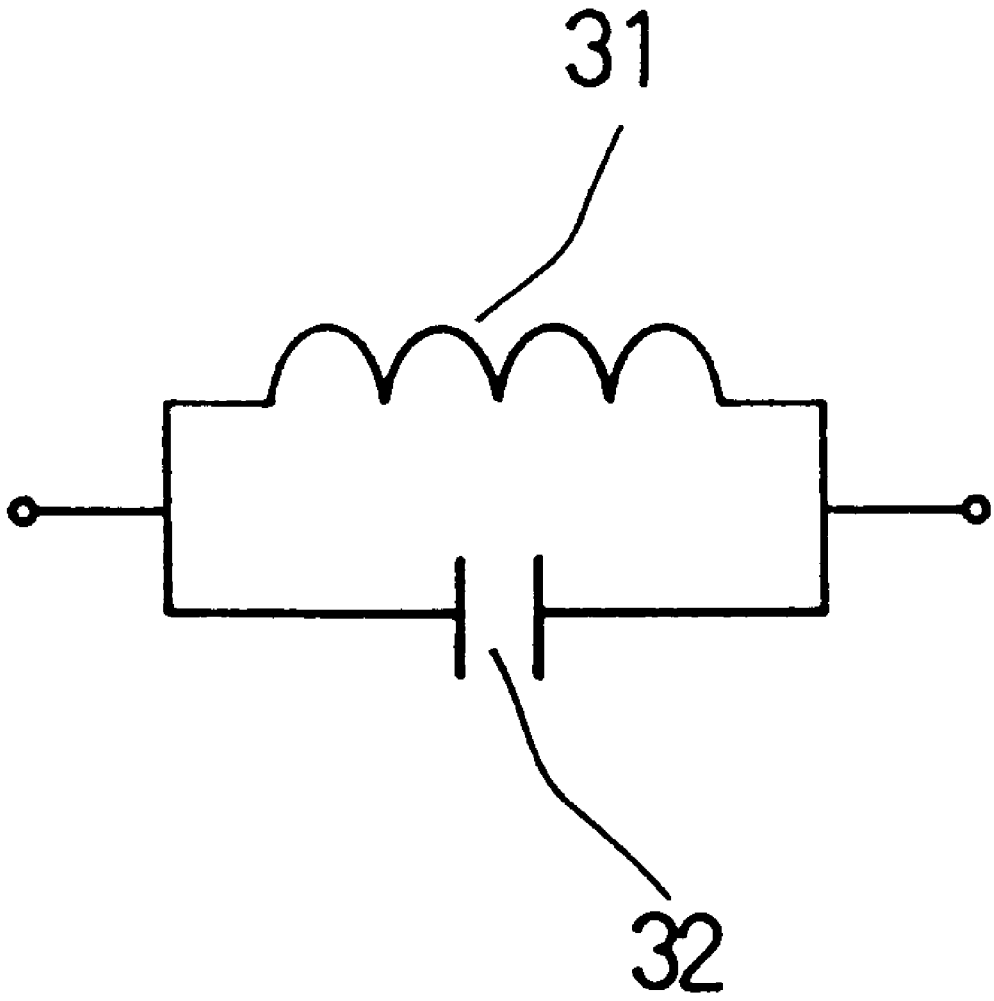
FIG. 3 shows an example of an anti-resonance circuit of the antenna elements in the first and the third embodiment of the present invention.

The anti-resonance circuits 23 and 25 comprise a coil 31 and a capacitor 32, as shown for example in FIG. 3.

The following is an explanation of the operation of a monopole antenna with the above-described configuration.

First of all, before going into details about the operation of this monopole antenna (and the multifrequency operation of antenna elements), an explanation of top-loading type monopole antennas, which form the basic structure of this monopole antenna, follows.

Figure 5A:
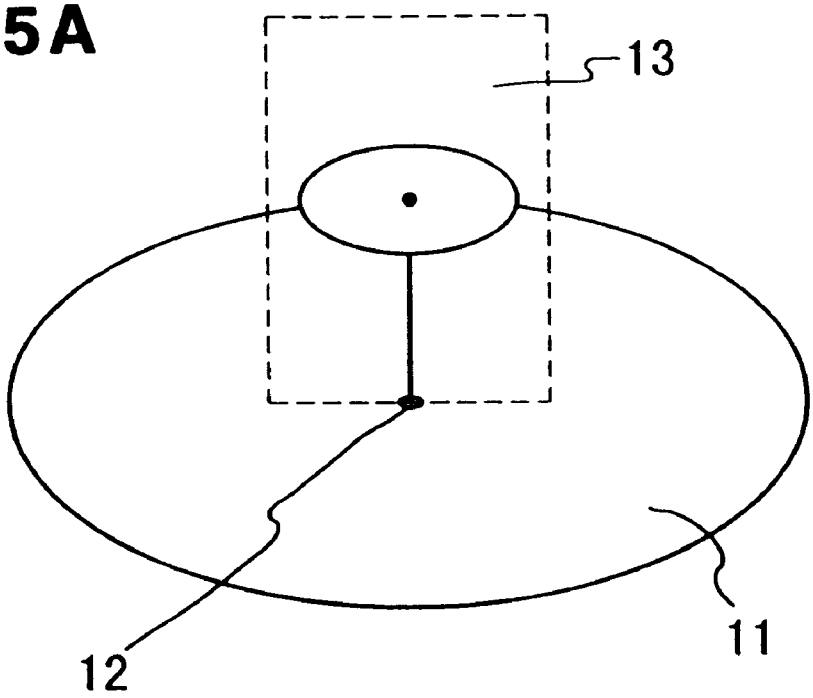
FIG. 5(*a*) is a schematic perspective view showing an example of a top-loading type monopole antenna according to the first embodiment of the present invention.
Figure 5B:
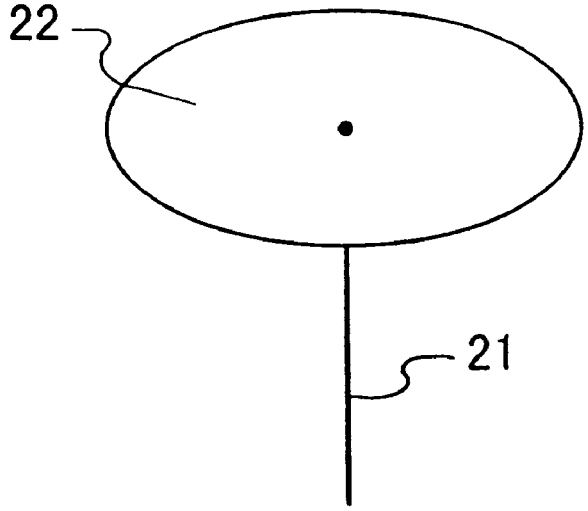

FIG. 5(*a*) is a schematic perspective view of a top-loading type monopole antenna. FIG. 5(*b*) is a schematic perspective view showing the antenna element in FIG. 5(*a*). In FIG. 5(*a*), numeral 11 denotes an earth conductor, numeral 12 denotes a current supply portion, and numeral 13 denotes an antenna element. In FIG. 5(*b*), numeral 21 denotes a linear conductor, and numeral 22 denotes a disk-shaped conductor.

Figure 6:
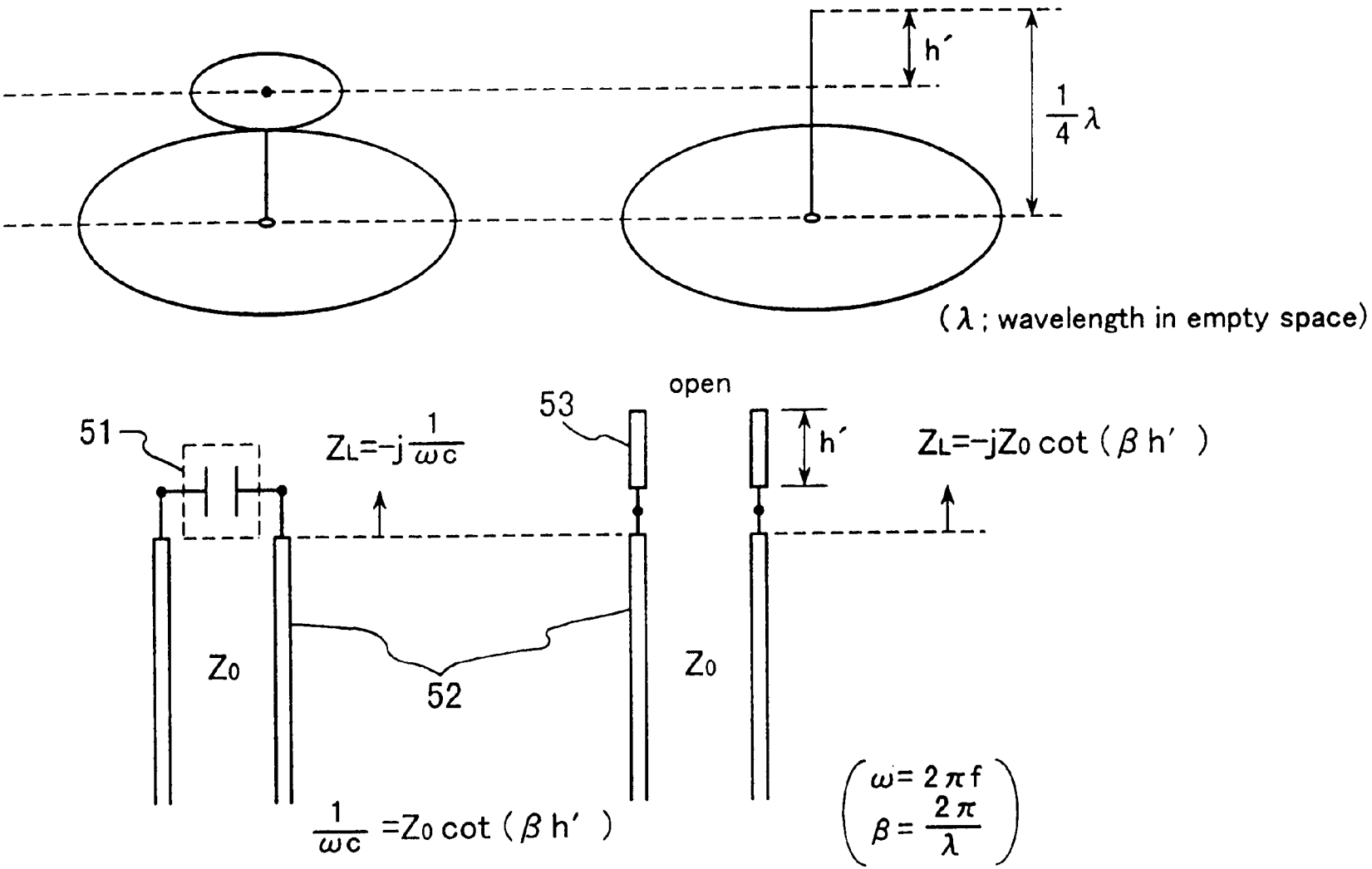
FIG. 6 illustrates the shortening of the top-loading type monopole antenna according to the first embodiment of the present invention.
Figure 7:
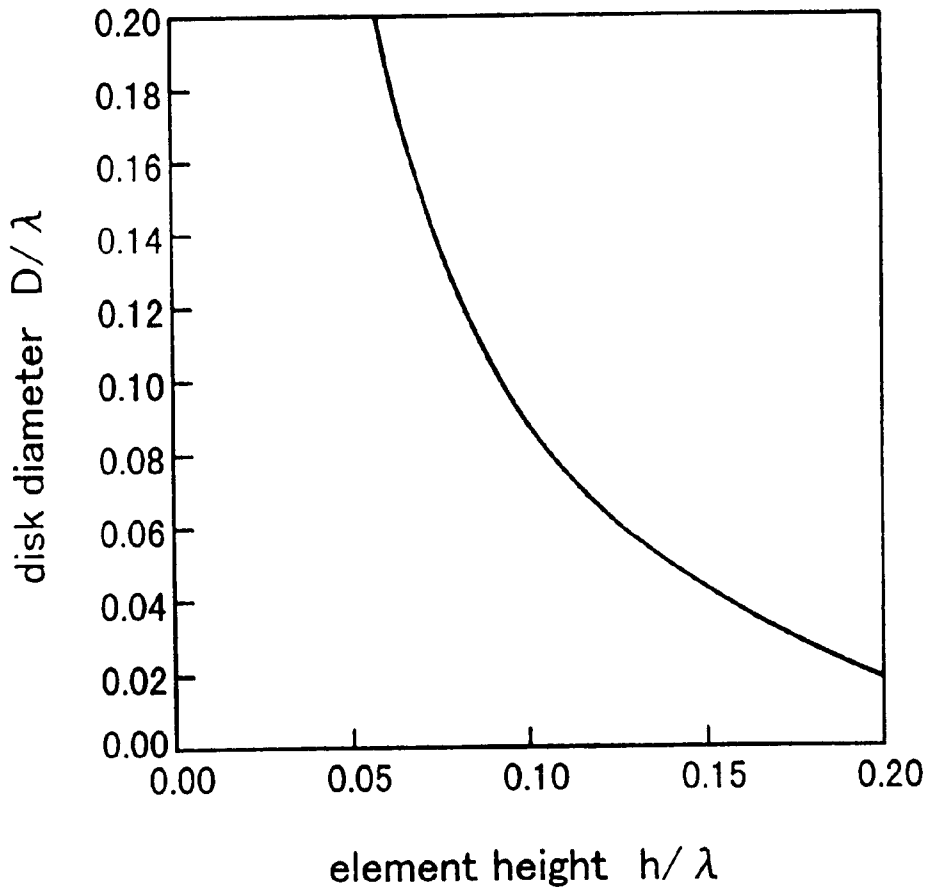
FIG. 7 illustrates the relation between the diameter of the disk-shaped conductor and the height of the antenna element in the top-loading type monopole antenna according to the first embodiment of the present invention at constant resonance frequency.
Figure 7:
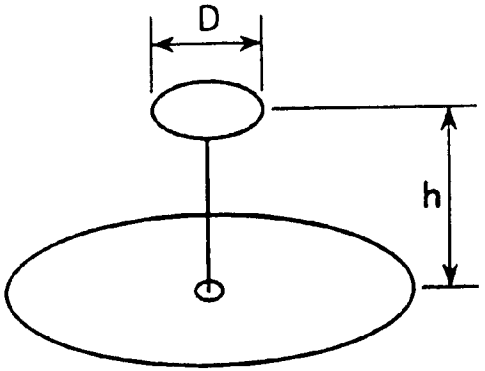

As is shown in FIG. 5(*b*), the antenna element 13 of the top-loading type monopole antenna comprises a linear conductor 21 and a disk-shaped conductor 22. The upper end of the linear conductor 21 is electrically connected perpendicularly to the center of the disk-shaped conductor 22. The disk-shaped conductor 22 and the earth conductor 11 can be thought to form a capacitor between them, so that the antenna element 13 is equivalent to a capacitive load connected to the upper end of the linear conductor 21. This situation is shown in FIG. 6. In FIG. 6, numeral 51 denotes an equivalent capacitor, and numerals 52 and 53 denote transmission lines. Furthermore, in FIG. 6, $\lambda$ denotes the wavelength in free space, f is the frequency, and the length h' of the transmission line 53 is the length of the portion that the antenna element 13 has become shorter due to the top-loading part. As is shown in FIG. 6, the top-loading type monopole antenna element 13 can be expressed as a capacitor 51 of the capacitance C connected to a transmission line 52, and a conventional ¼ wavelength monopole antenna element can be expressed as a transmission line 53 of line length h' with open ends connected to a transmission line 52. In other words, the length h' of the portion that the antenna element 13 is shorter due to the top-loading part is decided in a manner that the impedance of the capacitor 51 seen from the transmission line 52 is equivalent to the impedance of the transmission line 53 seen from the transmission line 52. The capacitance C of the antenna element 13 of the top-loading type monopole antenna is proportional to the diameter of the disk-shaped conductor 22, so that based on this reasoning, the relation between the diameter of the disk-shaped conductor 22 to the height of the antenna element 13 for constant resonance frequency becomes as shown in FIG. 7. As is shown in FIG. 7, by increasing the size of the disk-shaped conductor 22, the height of the antenna element 13 can be reduced.

The monopole antenna in accordance with this embodiment comprises a plurality of top-loading type monopole antennas that are resonant at certain frequencies and are designed with the above-described design method, integrated into one antenna.

The excitation of electromagnetic waves is performed with the system of the linear conductor 21 and the disk-shaped conductor 22 at a first frequency $f_1$, with the system extending from the linear conductor 21 to the ring-shaped conductor 24 at a second frequency $f_2$, and with the system extending from the linear conductor 21 to the ring-shaped conductor 26 at a third frequency $f_3$. In this configuration, the first frequency $f_1$ is the highest, the second frequency $f_2$ is intermediate, and the third frequency $f_3$ is the lowest.

To excite electromagnetic waves like this, the ring-shaped conductors 24 and 26 have to be electrically blocked out from the system consisting of the linear conductor 21 and the disk-shaped conductor 22 at the first frequency $f_1$, and the ring-shaped conductor 26 has to be electrically blocked out from the system extending from the linear conductor 21 to the ring-shaped conductor 24 at the second frequency $f_2$. Therefore, an anti-resonance circuit 23 is provided between the outer edge of the disk-shaped conductor 22 and the inner edge of the ring-shaped conductor 24, and an anti-resonance circuit 25 is provided between the outer edge of the ring-shaped conductor 24 and the inner edge of the ring-shaped conductor 26. The resonance frequency of the anti-resonance circuit 23 is matched to the first frequency $f_1$. As a result, the impedance of the anti-resonance circuit 23 at the first frequency $f_1$ is high, so that the disk-shaped conductor 22 and the ring-shaped conductor 24 are blocked from each other at this frequency. Consequently, an antenna that resonates at the first frequency $f_1$ is realized by the linear conductor 21 and the disk-shaped conductor 22. At frequencies that are lower than the first frequency $f_1$, the impedance of the anti-resonance circuit 23 becomes low, so that at these frequencies the disk-shaped conductor 22 and the ring-shaped conductor 24 are substantially electrically connected.

Similarly, if the resonance frequency of the anti-resonance circuit 25 is matched to the second frequency $f_2$, and the ring-shaped conductor 24 is electrically blocked from the ring-shaped conductor 26 at the second frequency $f_2$, an antenna that resonates at the second frequency $f_2$ is realized by the system extending from the linear conductor 21 to the disk-shaped conductor 24. At frequencies that are lower than the second frequency $f_2$, the impedance of the anti-resonance circuit 25 becomes low, so that at these frequencies the ring-shaped conductor 24 and the ring-shaped conductor 26 are substantially electrically connected.

Thus, a multifrequency monopole antenna operating at three different frequencies $f_1$, $f_2$, and $f_3$ can be obtained.

In the monopole antenna of this embodiment, by locating the current supply portion 12 in the middle of the surface of the disk-shaped earth conductor 11, connecting the linear conductor 21 perpendicularly at the center of the disk-shaped conductor 22, and by arranging the ring-shaped conductors 24 and 26 concentrically around the disk-shaped conductor 22, axial symmetry is established, so that radiation that has no directivity in the lateral direction becomes possible.

Figure 8A:
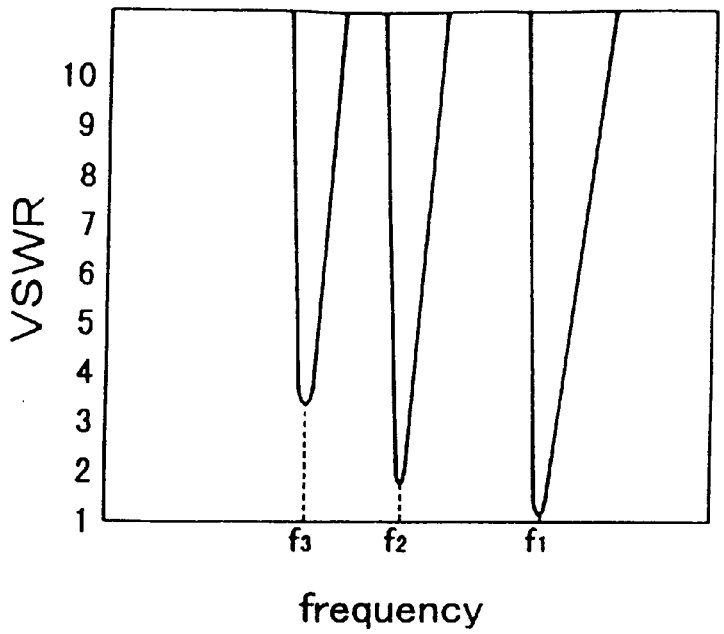
FIGS. 8(*a*) and (*b*) show an example of the characteristics of a monopole antenna according to the first embodiment of the present invention.
Figure 8B:
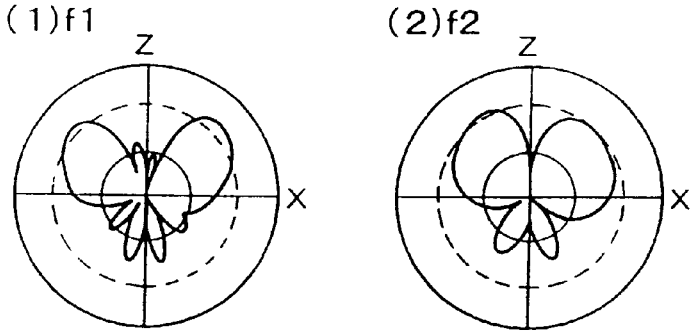
Figure 8B:
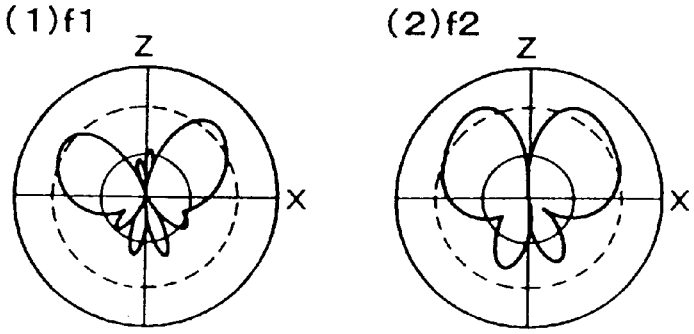

FIG. 8 shows the antenna properties of the monopole antenna according to this embodiment. FIG. 8(*a*) shows the VSWR characteristics of the input impedance of a sample antenna, and FIG. 8(*b*) shows the radiation characteristics of this sample antenna.

As can be seen in FIG. 8(*a*), the monopole antenna is resonant at the frequencies $f_1$, $f_2$, and $f_3$.

To give an example, FIG. 8(*b*) compares the radiation characteristics at the frequencies $f_1$ and $f_2$ of two single conventional monopole antenna to the radiation characteristics of the monopole antenna of this embodiment. As is shown in FIG. 8(*b*), the inventive monopole antenna can be operated at a plurality of frequencies, and also displays the same characteristics as the two single monopole antennas at a plurality of operation frequencies.

Thus, in accordance with this embodiment, a monopole antenna can be obtained that has a compact and simple configuration, can be operated at a plurality of frequencies, and shows the same characteristics as several single monopole antennas at a plurality of operation frequencies.

Furthermore, in this embodiment, the anti-resonance circuits 23 and 25 included parallel circuits of a coil 31 and a capacitor 32, but the configuration of the anti-resonance circuits 23 and 25 is by no means limited to this configuration.

Moreover, in this embodiment, both anti-resonance circuits 23 and 25 included parallel circuits of a coil 31 and a capacitor 32, but the configuration of the anti-resonance circuits 23 and 25 is by no means limited to this configuration, and it is also possible to let either the anti-resonance circuit 23 or the anti-resonance circuit 25 include a coil 31 and a capacitor 32, and take only a coil 31 for the other anti-resonance circuit 25 or 23.

Second Embodiment

The second embodiment of the present invention is explained with reference to FIGS. 1, 2 and 4.

The configuration of a monopole antenna according to this embodiment is the same as the configuration for the first embodiment (see FIG. 1). Furthermore, the configuration of the antenna parts of this embodiment is also the same as in the first embodiment (see FIG. 2). However, in this embodiment, the anti-resonance circuits 23 and 25 consist only of a coil 41, as shown for example in FIG. 4.

The operation of the monopole antenna of this embodiment is the same as in the first embodiment, only that the monopole antenna of this embodiment makes use of the high-frequency blocking characteristics of the coils 41. That is to say, by selecting coils 41 of appropriate size, the impedance of the coils 41 can be made high at desired frequencies, and the disk-shaped conductor 22 and the ring-shaped conductor 24, or the ring-shaped conductor 24 and the ring-shaped conductor 26 in FIG. 2 can be substantially electrically blocked from each other. At lower frequencies, the impedance of the coils 41 becomes low, so that they are substantially conductive. Thus, a monopole antenna can be obtained that can be operated at a plurality of frequencies.

Since in this embodiment the anti-resonance circuits 23 and 25 consist only of a coil 41, the number of parts can be reduced.

Thus, in accordance with this embodiment, a monopole antenna can be obtained that has a very simple configuration, can be operated at a plurality of frequencies, and shows the same characteristics as single monopole antennas at a plurality of operation frequencies.

Moreover, in this embodiment, both anti-resonance circuits 23 and 25 consist of only a coil 41, but the configuration of the anti-resonance circuits 23 and 25 is by no means limited to this configuration, and it is also possible to let either the anti-resonance circuit 23 or the anti-resonance circuit 25 consist of only a coil 41, and take a parallel circuit of a coil 41 and a capacitor for the other anti-resonance circuit 25 or 23.

Third Embodiment

The third embodiment of the present invention is explained with reference to FIGS. 1, 3 and 9.

The configuration of a monopole antenna according to this embodiment is the same as the configuration for the first embodiment (see FIG. 1).

Figure 9:
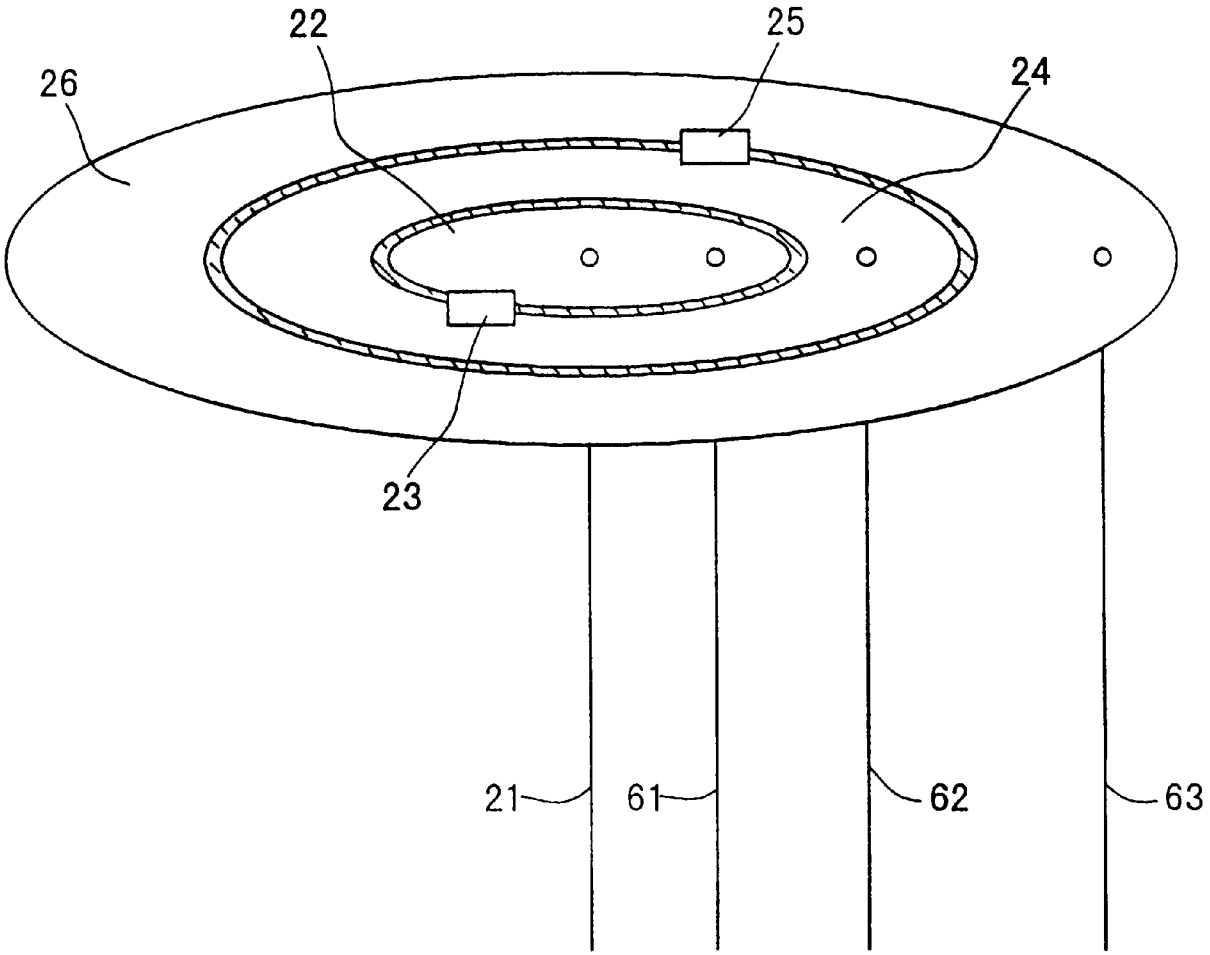
FIG. 9 is a schematic perspective view showing the antenna element in a third and a fourth embodiment of the present invention.

FIG. 9 is a schematic perspective view showing the antenna element of FIG. 1 for this embodiment. As an example, this drawing shows a three-frequency monopole antenna. In FIG. 9, numeral 21 denotes a linear conductor, numeral 22 denotes a disk-shaped conductor, numeral 23 denotes an anti-resonance circuit, numeral 24 denotes a ring-shaped conductor, numeral 25 denotes an anti-resonance circuit, and numeral 26 denotes a ring-shaped conductor. Numerals 61, 62, and 63 denote earth wires. The disk-shaped conductor 22, the ring-shaped conductor 24, and the ring-shaped conductor 26 are arranged on the same plane in concentric rings starting with the disk-shaped conductor 22 on the inside. One end of the linear conductor 21 is electrically connected perpendicularly to the center of the disk-shaped conductor 22. The outer edge of the disk-shaped conductor 22 is connected to the inner edge of the ring-shaped conductor 24 via the anti-resonance circuit 23. The outer edge of the ring-shaped conductor 24 is connected to the inner edge of the ring-shaped conductor 26 via the anti-resonance circuit 25. In addition, the disk-shaped conductor 22, the ring-shaped conductor 24 and the ring-shaped conductor 26 are connected by an earth wire 61, an earth wire 62 and an earth wire 63 to the earth conductor 11 (see FIG. 1).

The anti-resonance circuits 23 and 25 are parallel circuits comprising a coil 31 and a capacitor 32, as shown for example in FIG. 3.

The operation of a monopole antenna according to this embodiment is the same as the operation of a monopole antenna according to the first embodiment.

In the monopole antenna according to the above-explained first embodiment of the present invention, the antenna height could be decreased by using the disk-shaped conductor 22 and the ring-shaped conductors 24 and 26 for the antenna element 13. However, when using such a configuration, the input impedance of the antenna at the operation frequencies is lowered, and sometimes the impedance matching with the current supply portion 12 worsens. When the impedance matching with the current supply portion 12 worsens, the electric power supplied to the antenna element diminishes, and the radiation efficiency of the antenna deteriorates.

In this case, the impedance matching with the current supply portion 12 has to be improved to improve the antenna characteristics by raising the input impedance of the antenna at the various operation frequencies Therefore, the disk-shaped conductor 22 and the ring-shaped conductors 24 and 26 are connected to the earth conductor 11 through the earth wires 61, 62, and 63. This raises the input impedance of the antenna at the various operating frequencies and as a result, the impedance matching between the antenna input impedance and the impedance of the current supply portion 12 at the various operating frequencies is improved, which improves the characteristics of the antenna.

Thus, with this embodiment, the impedance matching between the antenna input impedance and the impedance of the current supply portion can be improved, and a monopole antenna can be obtained that can be operated at a plurality of frequencies with excellent radiation efficiency.

In the monopole antenna of this embodiment, by positioning the current supply portion 12 at the center of the surface of the disk-shaped earth conductor 11, connecting the linear conductor 21 at the center of the disk-shaped conductor 22 so that it stands perpendicularly on the disk-shaped conductor 22, and by arranging the ring-shaped conductors 24 and 26 concentrically around the disk-shaped conductor 22, axial symmetry is established, so that radiation becomes possible without directivity in the lateral direction of the antenna.

Furthermore, in this embodiment, the anti-resonance circuits 23 and 25 included parallel circuits of a coil 31 and a capacitor 32, but the configuration of the anti-resonance circuits 23 and 25 is by no means limited to this configuration.

Moreover, in this embodiment, both anti-resonance circuits 23 and 25 included parallel circuits of a coil 31 and a capacitor 32, but the configuration of the anti-resonance circuits 23 and 25 is by no means limited to this configuration, and it is also possible to let either the anti-resonance circuit 23 or the anti-resonance circuit 25 include a parallel circuit comprising a coil 31 and a capacitor 32, and take only a coil 31 for the other anti-resonance circuit 25 or 23.

Moreover, in this embodiment, each of the disk-shaped conductor 22 and the ring-shaped conductors 24 and 26 is grounded to the earth conductor 11, but it is sufficient if at least one of the disk-shaped conductor 22 and the ring-shaped conductors 24 and 26 is grounded to the earth conductor 11.

Fourth Embodiment

The fourth embodiment of the present invention is explained with reference to FIGS. 1, 4 and 9.

The configuration of a monopole antenna according to this embodiment is the same as the configuration for the first embodiment (see FIG. 1). Moreover, the configuration of the antenna element in this embodiment is the same as for the third embodiment (see FIG. 9).

Figure 4:
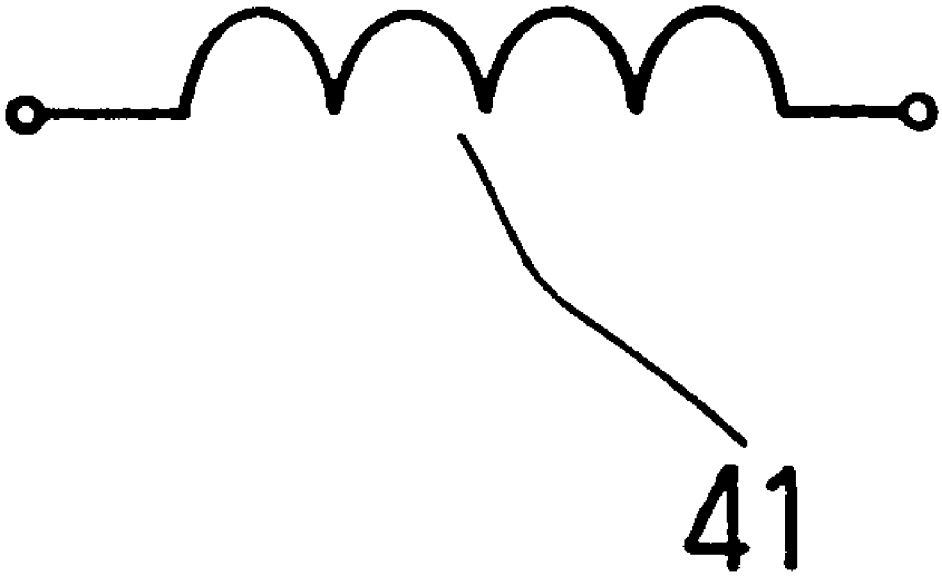
FIG. 4 shows an example of an anti-resonance circuit of the antenna elements in the second and the fourth embodiment of the present invention.

The anti-resonance circuits 23 and 25 consist of only a coil 41, as shown for example in FIG. 4.

The operation of the monopole antenna of this embodiment is the same as in the third embodiment, only that the monopole antenna of this embodiment makes use of the high-frequency blocking characteristics of the coils 41. That is to say, by selecting coils 41 of appropriate size, the impedance of the coils 41 can be made high at desired frequencies, and the disk-shaped conductor 22 and the ring-shaped conductor 24, or the ring-shaped conductor 24 and the ring-shaped conductor 26 in FIG. 9 can be substantially electrically blocked from each other. At lower frequencies, the impedance of the coils 41 becomes low, so that they are substantially conductive. Thus, a monopole antenna can be obtained that can be operated at a plurality of frequencies.

Since in this embodiment the anti-resonance circuits 23 and 25 consist only of a coil 41, the number of parts can be reduced.

Thus, in accordance with this embodiment, a monopole antenna with good radiation efficiency can be obtained that has a very simple configuration, can be operated at a plurality of frequencies, and shows the same characteristics as several monopole antennas at a plurality of operation frequencies.

Moreover, in this embodiment, each of the disk-shaped conductor 22 and the ring-shaped conductors 24 and 26 is grounded to the earth conductor 11, but it is sufficient if at least one of the disk-shaped conductor 22 and the ring-shaped conductors 24 and 26 is grounded to the earth conductor 11.

Fifth Embodiment

The fifth embodiment of the present invention is explained with reference to FIGS. 1, 10 and 11.

The configuration of a monopole antenna according to this embodiment is the same as the configuration for the first embodiment (see FIG. 1).

Figure 10:
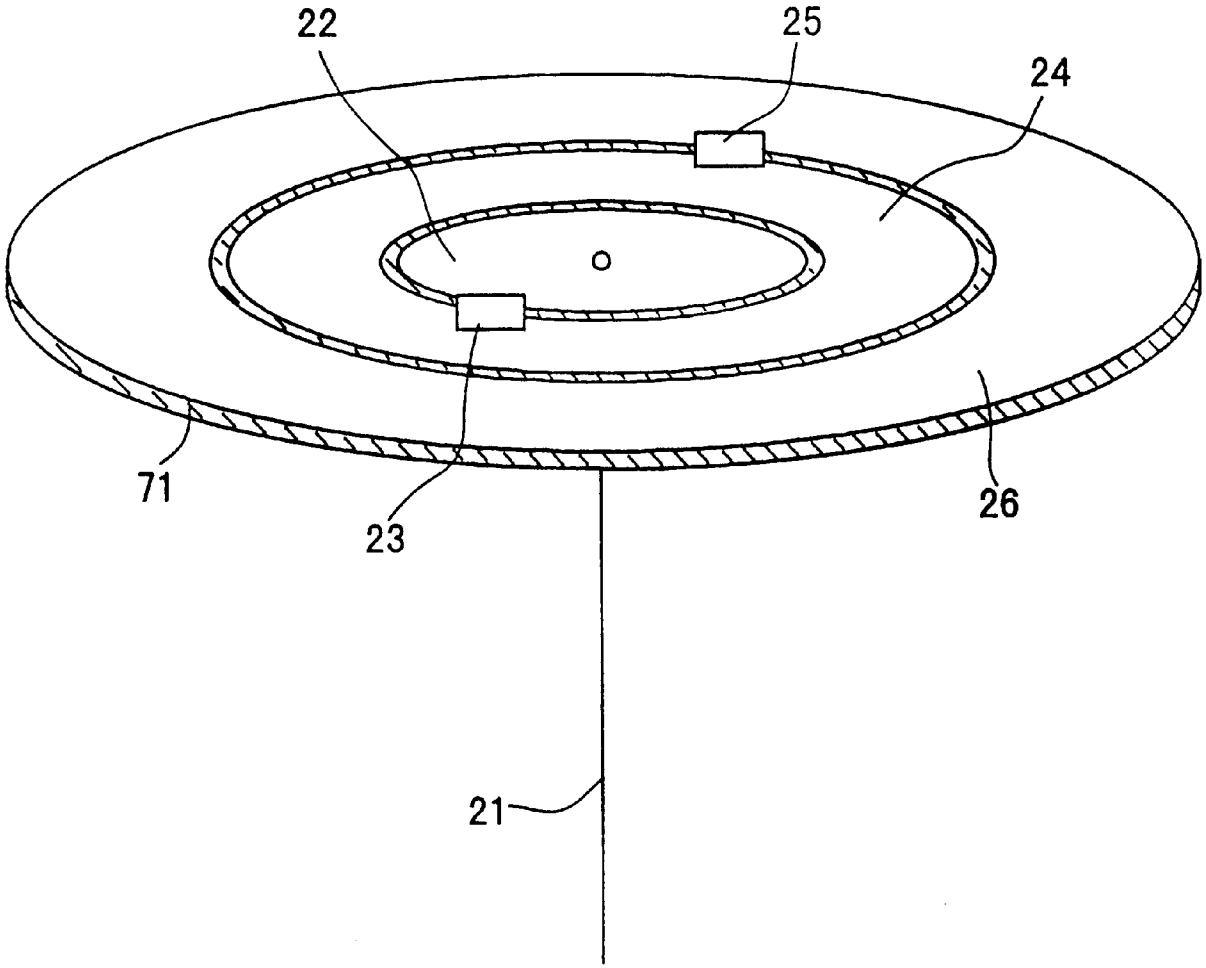
FIG. 10 is a schematic perspective view showing the antenna element in a fifth embodiment of the present invention.

FIG. 10 is a schematic perspective view showing the antenna element of FIG. 1. As an example, this drawing shows a three-frequency monopole antenna. In FIG. 10, numeral 21 denotes a linear conductor, numeral 22 denotes a disk-shaped conductor, numeral 23 denotes an anti-resonance circuit, numeral 24 denotes a ring-shaped conductor, numeral 25 denotes an anti-resonance circuit, numeral 26 denotes a ring-shaped conductor, and numeral 71 denotes a dielectric substrate. The disk-shaped conductor 22, the ring-shaped conductor 24, and the ring-shaped conductor 26 are arranged on the same plane in concentric rings starting with the disk-shaped conductor 22 on the inside. One end of the linear conductor 21 is connected perpendicularly to the center of the disk-shaped conductor 22. The outer edge of the disk-shaped conductor 22 is connected to the inner edge of the ring-shaped conductor 24 via the anti-resonance circuit 23. The outer edge of the ring-shaped conductor 24 is connected to the inner edge of the ring-shaped conductor 26 via the anti-resonance circuit 25. In addition, the disk-shaped conductor 22, the ring-shaped conductors 24 and 26, and the anti-resonance circuits 23 and 25 are patterned onto the dielectric substrate 71.

Figure 11:
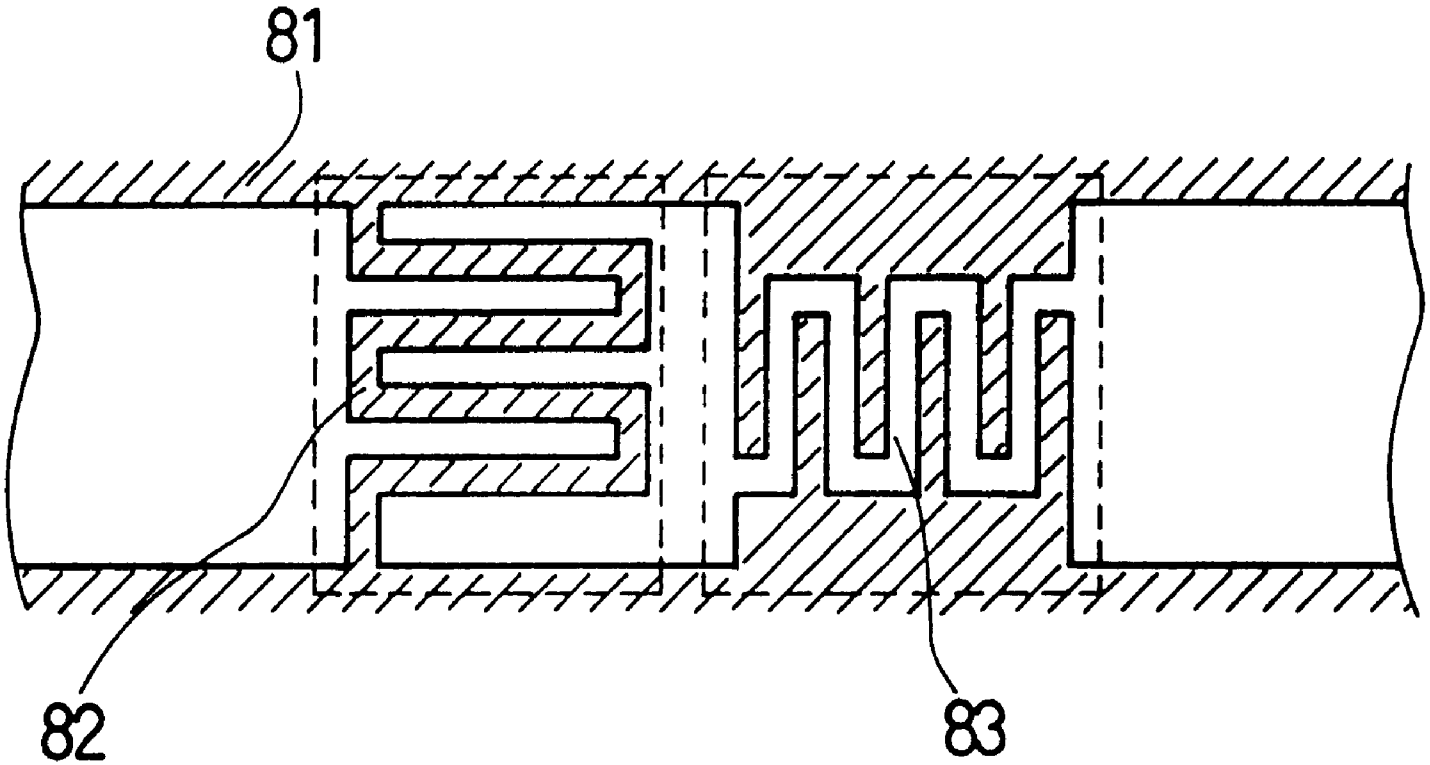
FIG. 11 shows an example of an anti-resonance circuit of the antenna element in the fifth embodiment of the present invention.

FIG. 11 illustrates the metallic conductive pattern of the anti-resonance circuits 23 and 25 in FIG. 10 on the dielectric substrate 71. Numeral 81 indicates the metallic pattern formed on the dielectric substrate 71. The pattern for the anti-resonance circuits 23 and 25 can be for example a parallel circuit including a coil pattern 82 and a capacitor pattern 83, as shown in FIG. 11. By adjusting the coil pattern 82 and the capacitor pattern 83, electric blocking at the desired frequency can be achieved, and it becomes possible to operate this monopole antenna at a plurality of frequencies.

Thus, with this embodiment, the manufacturing precision and the reliability of the antenna element are improved, and a monopole antenna can be obtained that can be operated at a plurality of frequencies.

Moreover, in this embodiment, both anti-resonance circuits 23 and 25 include parallel circuits of a coil pattern 82 and a capacitor pattern 83, but the configuration of the anti-resonance circuits 23 and 25 is by no means limited to this configuration, and it is also possible to let either the anti-resonance circuit 23 or the anti-resonance circuit 25 include a parallel circuit comprising a coil pattern 82 and a capacitor pattern 83, and take only a coil pattern 82 for the other anti-resonance circuit 25 or 23.

Moreover, in this embodiment, both anti-resonance circuits 23 and 25 are patterned on the dielectric substrate 71, but it is also possible to form either the anti-resonance circuit 23 or the anti-resonance circuit 25 by patterning on the dielectric substrate 71, and not form the other anti-resonance circuit 25 or 23 by patterning on the dielectric substrate 71.

The above first to fifth embodiments have been explained taking a three-frequency monopole antenna as an example, however the present invention is not limited to monopole antennas of such a configuration. For example, by taking only one ring-shaped conductor, a two-frequency monopole antenna can be obtained, and by taking three or more ring-shaped conductors, a monopole antenna that is operable at four or more frequencies can be obtained.

Furthermore, the above first to fifth embodiments have been explained taking a three-frequency monopole antenna provided with a disk-shaped earth conductor 11 as an example, however the present invention is not limited to such a configuration. The earth conductor can be of any shape, for example elliptical or polygonal such as triangular.

Furthermore, the above first to fifth embodiments have been explained taking a three-frequency monopole antenna as an example that uses a disk-shaped conductor 22 for the planar conductor and ring-shaped conductors 24 and 26 that are concentrically arranged around the disk-shaped conductor 22 for the ring-shaped conductors, however the present invention is not limited to such a configuration. The planar conductor and the ring-shaped conductors can be of any shape, for example elliptical or polygonal such as triangular.

Furthermore, the above first to fifth embodiments have been explained taking a three-frequency monopole antenna as an example that has axial symmetry, however the present invention is not limited to monopole antennas of such a configuration. For example, the current supply portion 12 also can be located at a position outside the center of the earth conductor 11. By using such a configuration, directivity is introduced into the electromagnetic waves that are radiated from the antenna, and a monopole antenna can be obtained that has a strong directivity with respect to one direction in the horizontal plane.

Furthermore, the above first to fifth embodiments have been explained taking a three-frequency monopole antenna as an example where the disk-shaped conductor 22 is connected perpendicularly to the linear conductor 21, however the present invention is not limited to such a configuration. For example, the disk-shaped conductor 22 also can be connected obliquely to the linear conductor 21. With such a configuration, the input impedance can be changed, and the matching with the current supply portion 12 can be improved.

Figure 12A:
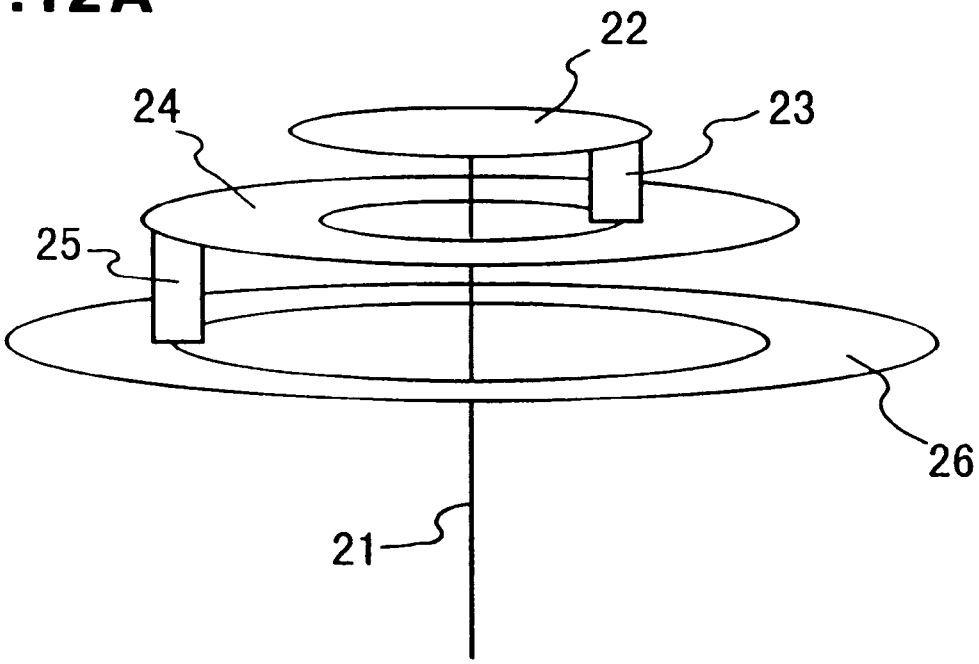
FIG. 12 is a schematic perspective view of an antenna element in which the disk-shaped conductor and the ring-shaped conductors are arranged in different planes.
Figure 12B:
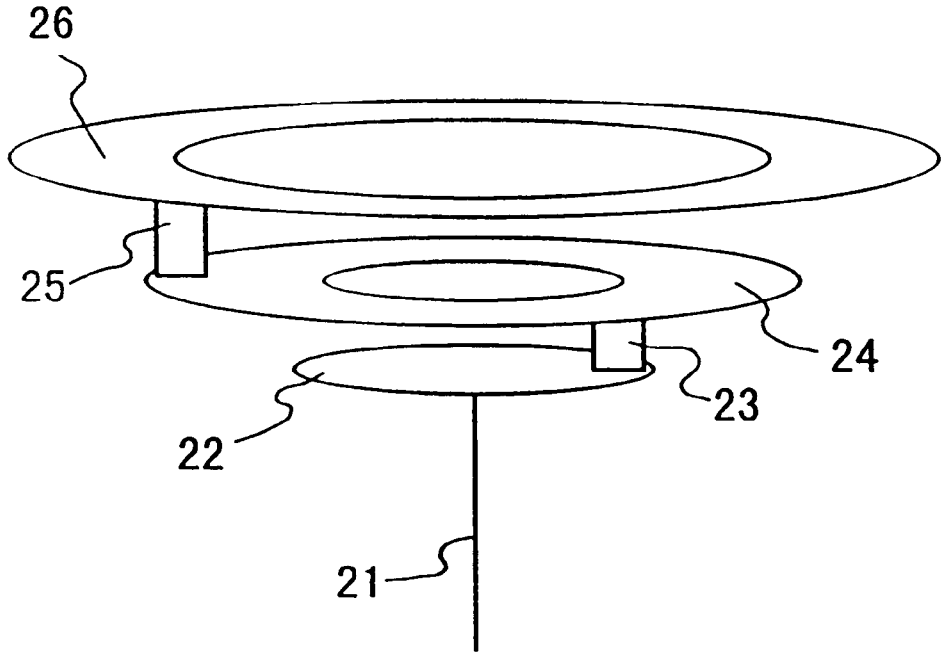

Furthermore, the above first to fifth embodiments have been explained taking a three-frequency monopole antenna as an example where the disk-shaped conductor 22 and the ring-shaped conductors 24 and 26 are arranged on the same plane, however the present invention is not limited to this configuration. For example, the disk-shaped conductor 22 and the ring-shaped conductors 24 and 26 can be arranged in different planes, or at least one of the plurality of ring-shaped conductors 24 and 26 can be arranged in a different plane than the disk-shaped conductor 22. To be specific, FIGS. 12(*a*) and (*b*) show monopole antennas, where the disk-shaped conductor 22, the ring-shaped conductor 24 and the ring-shaped conductor 26 are all arranged in different planes. FIG. 12(*a*) shows a monopole antenna in which the ring-shaped conductors 24 and 26 are located in a plane that is lower than the disk-shaped conductor 22, whereas FIG. 12(*b*) shows a monopole antenna, in which the ring-shaped conductors 24 and 26 are located in a plane that is higher than the disk-shaped conductor 22. When a support for the ring-shaped conductors 24 and 26 has to be provided, support rods of, for example, an insulator, Teflon (polytetrafluoroethylene), or glass epoxy can be used.

Figure 13:
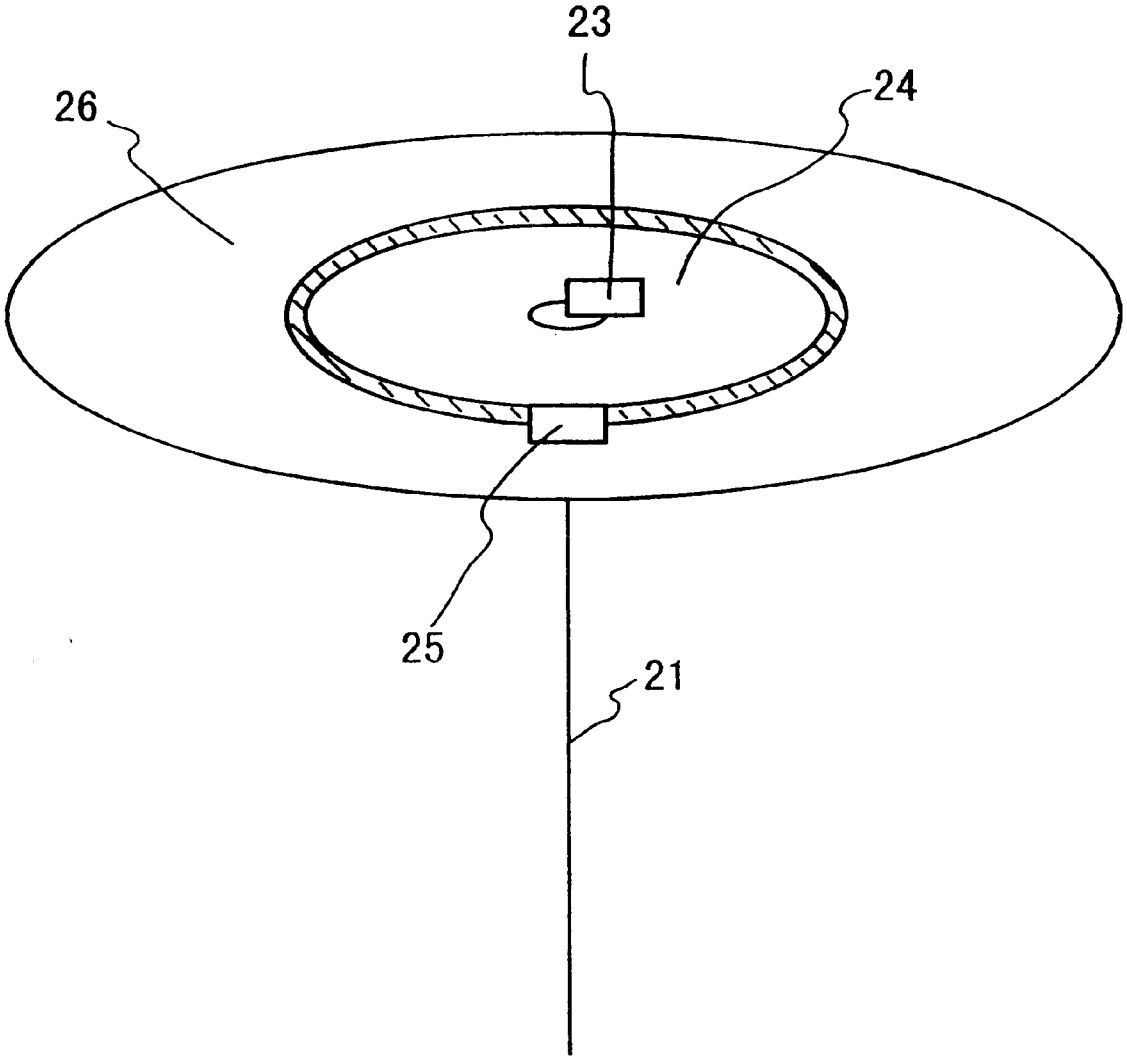
FIG. 13 is a schematic perspective view of an antenna element comprising a linear conductor and a ring-shaped element.

Furthermore, the above first to fifth embodiments have been explained taking as an example a monopole antenna that comprises a linear conductor 21 connected with one end to a current supply portion 12 that is located on the surface of an earth conductor 11, a disk-shaped conductor 22 connected to the other end of the linear conductor 21, a ring-shaped conductor 24 whose inner edge is connected to the outer edge of the disk-shaped conductor 22 via the anti-resonance circuit 23, and a ring-shaped conductor 26 whose inner edge is connected to the outer edge of the ring-shaped conductor 24 via the anti-resonance circuit 25. However the present invention is not limited to this configuration. For example, as is shown in FIG. 13, it is also possible that the antenna portion comprises a linear conductor 21 connected to a current supply portion whose one end is arranged on the surface of the earth conductor, a ring-shaped conductor 24 whose inner edge is connected to the other end of the linear conductor 21 via an anti-resonance circuit 23, and a ring-shaped conductor 26 whose inner edge is connected to the outer edge of the ring-shaped conductor 24 via an anti-resonance circuit 25. In this case, if the resonance frequency of the anti-resonance circuit 23 is set to $f_1$ and the resonance frequency of the anti-resonance circuit 25 is set to $f_2$ (with $f_1>f_2$), the frequency f1 is excited by the linear conductor 21 only, and the frequency f2 is excited by the system extending from the linear conductor 21 to the ring-shaped conductor 24, and frequency $f_3$ is excited by the system extending from the linear conductor 21 to the ring-shaped conductor 26.

Sixth Embodiment

A sixth embodiment of the present invention is explained with reference to FIG. 14.

Figure 14:
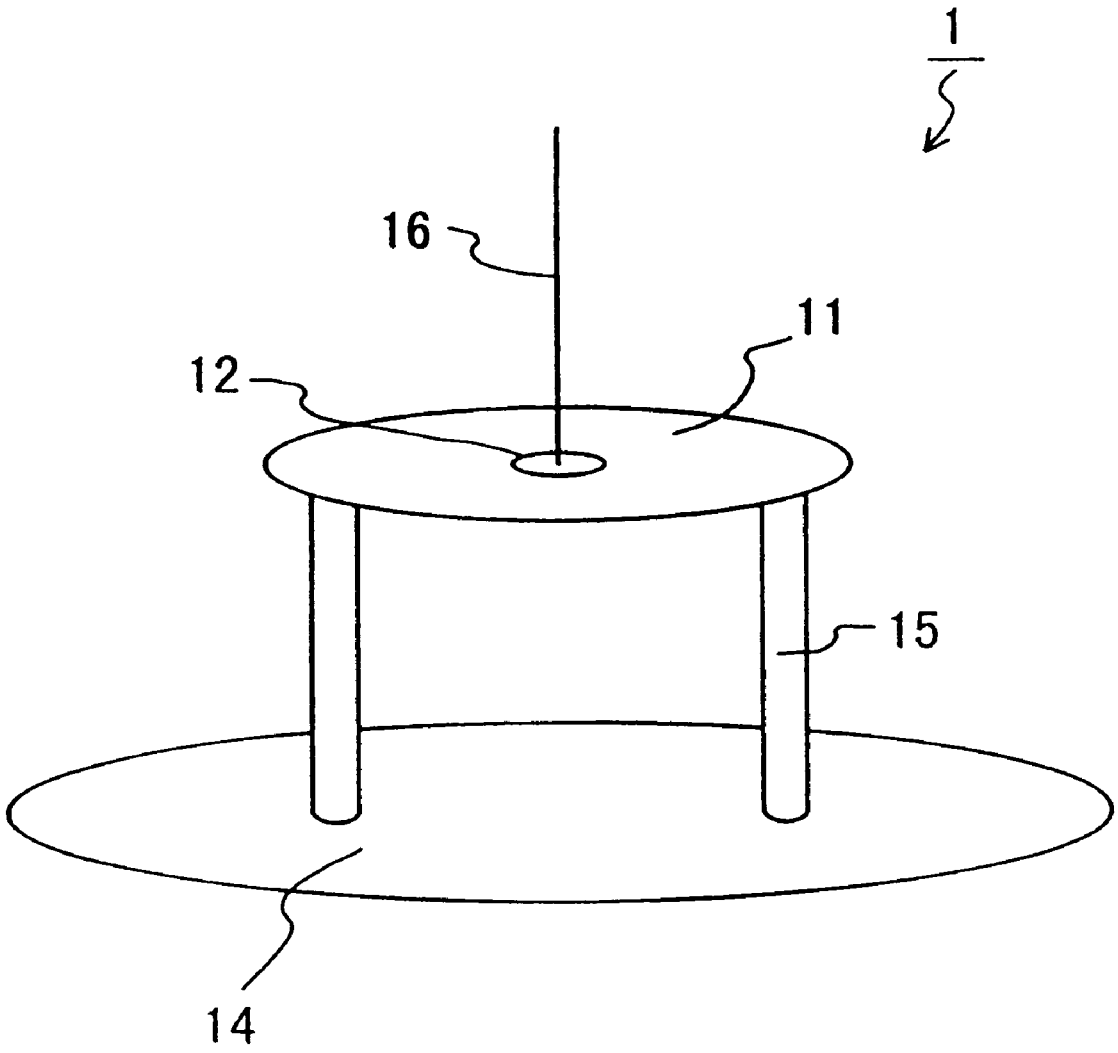
FIG. 14 is a schematic perspective view showing a monopole antenna of a sixth embodiment of the present invention.
Figure 15A:
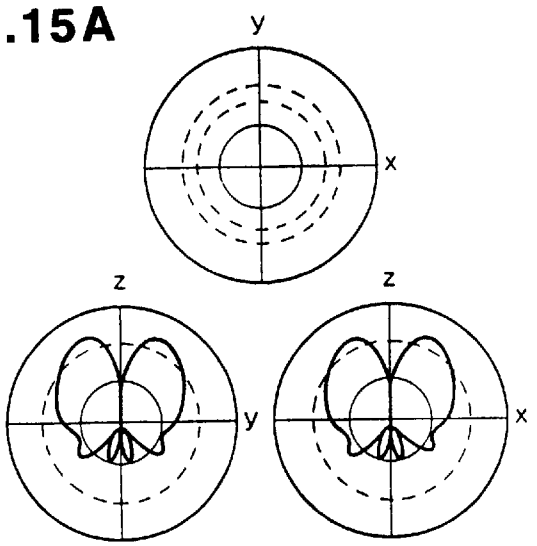
FIGS. 15(*a*)–(*d*) illustrate the characteristics of a monopole antenna of a sixth embodiment of the present invention and of a conventional monopole antenna.
Figure 15B:
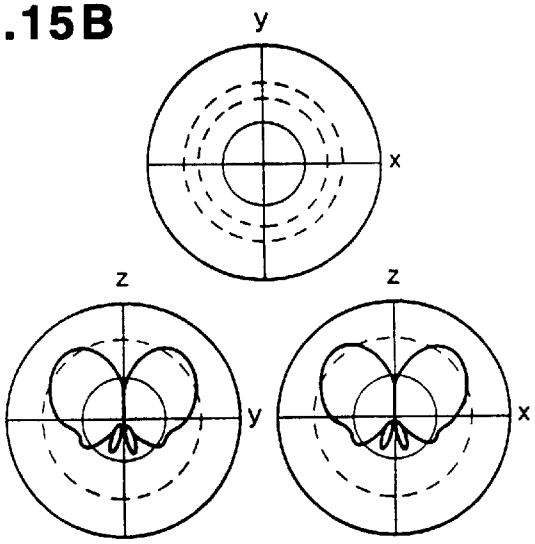
Figure 15C:
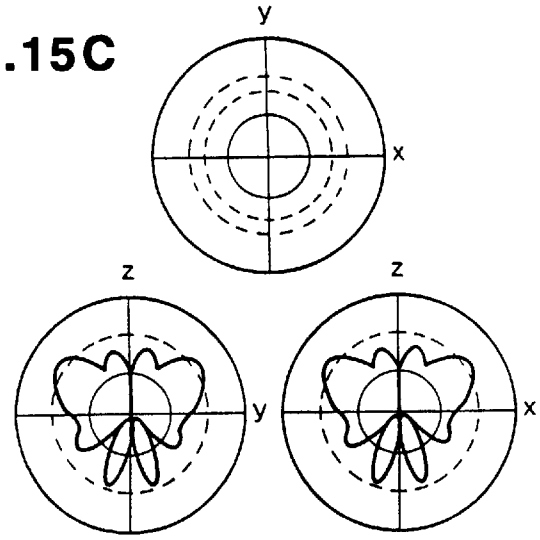
Figure 15D:
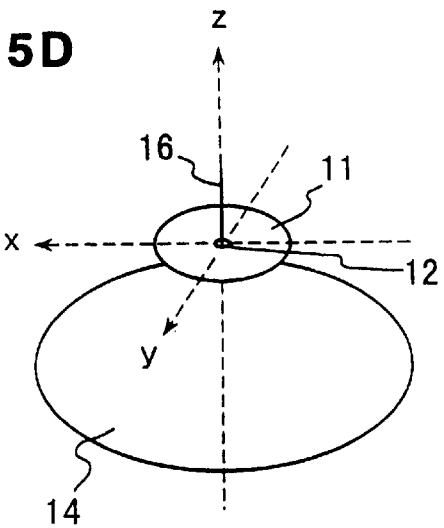

FIG. 14 is a schematic perspective view showing a monopole antenna according to a sixth embodiment of the present invention. In FIG. 14, numeral 11 denotes a disk-shaped earth conductor of limited size, numeral 12 denotes a current supply portion located at the center of the earth conductor 11, numeral 16 denotes an antenna element made of a linear conductor, and numeral 14 denotes a disk-shaped reflection conductor. The current supply portion 12 is arranged on the surface of the earth conductor 11, and the antenna element 16 is electrically connected to the current supply portion 12 so that it stands perpendicularly on the earth conductor 11. The reflection conductor 14 is arranged in parallel and concentrically to the earth conductor 11 on the side of the earth conductor 11 that is opposite the side on which the antenna element 16 is arranged, in a manner that the reflection conductor 14 is electrically coupled to the earth conductor 11 through the space between the two. The earth conductor 11 and the reflection conductor 14 are attached to each other with support rods 15 made of a an insulator or a dielectric material such as Teflon (polytetrafluoroethylene) or glass epoxy.

Thus, the monopole antenna 1 of this embodiment is axially symmetric. Therefore, radiation becomes possible without directivity in the lateral direction of the antenna.

The following is an explanation of this monopole antenna.

Excitation of electromagnetic waves is carried out in the antenna element 16. A standing wave of current with the resonance frequency $f_0$ is generated in the antenna element 16, so that an electromagnetic wave with the frequency $f_0$ is radiated. At the same time, an electric current of opposite phase flows in the earth conductor 11, so that an electromagnetic wave also is radiated from the edge portion of the earth conductor 11. Because the monopole antenna 1 is provided with an earth conductor 11 with limited size, its electromagnetic radiation corresponds to the sum of the radiation from the antenna element 16 and the radiation from edge of the earth conductor 11, which are both radiation sources. Moreover, since the monopole antenna 1 is provided with a reflection conductor 14 that is arranged in opposition to the earth conductor 11 on the side of the earth conductor 11 that is opposite the side on which the antenna element 16 is arranged, in a manner that the reflection conductor 14 is electrically coupled to the earth conductor 11 through the space between the two, a current flows also in the reflection conductor 14 due to this electric coupling, so that an electromagnetic wave is also radiated from an edge portion of the reflection conductor 14. Consequently, the electromagnetic radiation from this monopole antenna corresponds to the sum of the radiation from the antenna element 16, the radiation from the edge portion of the earth conductor 11, and the radiation from the edge portion of the reflection conductor 14. Therefore, by changing the size of the earth conductor 11 and the reflection conductor 14, or the distance between the earth conductor 11 and the reflection conductor 14, the directivity of this monopole antenna 1 can be changed.

FIG. 15 illustrates the antenna properties of a monopole antenna 1 that has been manufactured for trial purposes according to this embodiment. The monopole antennas $\mathbf{1}_1$, $\mathbf{1}_2$, and 1' are axially symmetric and are provided with a linear conductor of ¼ wavelength as the antenna element 16. FIGS. 15(*a*) and 15(*b*) show the radiation directivity of the monopole antennas $\mathbf{1}_1$ and $\mathbf{1}_2$, which are provided with a reflection conductor 14 in accordance with the present embodiment, whereas FIG. 15(*c*) shows the radiation directivity of a conventional monopole antennas 1', which is not provided with a reflection conductor 14. More specifically, FIG. 15(*a*) illustrates the radiation directivity of a monopole antenna $\mathbf{1}_1$ in accordance with this embodiment, which is provided with a disk-shaped earth conductor 11 having a diameter of one wavelength at the resonance frequency of the antenna element 16, a disk-shaped resonance conductor 14 having a diameter of two wavelengths of the resonance frequency of the antenna element 16, wherein the distance between the earth conductor 11 and the reflection conductor 14 is ¼ the resonance wavelength of the antenna element 16. FIG. 15(*b*) illustrates the radiation directivity of a monopole antenna $\mathbf{1}_2$ in accordance with this embodiment, which is provided with a disk-shaped earth conductor 11 having a diameter of 1.25 wavelengths of the resonance frequency of the antenna element 16, a disk-shaped resonance conductor 14 having a diameter of two wavelengths of the resonance frequency of the antenna element 16, wherein the distance between the earth conductor 11 and the reflection conductor 14 is ¼ the resonance wavelength of the antenna element 16. FIG. 15(*c*) shows the radiation directivity of a conventional monopole antenna 1' provided with a disk-shaped earth conductor 11 having a diameter of two wavelengths of the resonance frequency of the antenna element 16. As can be seen in FIG. 15(*d*), the directions x and y in these drawings correspond to the plane that is parallel to the faces of the earth conductor 11 and the reflection conductor 14, whereas z corresponds to the direction that is perpendicular to the faces of the earth conductor 11 and the reflection conductor 14. In the radiation directivity graphs, the distance between two scaling rings corresponds to 10 dB, measured in dBd, which takes the gain of a dipole antenna as the standard.

As is shown in FIG. 15(*a*), the monopole antenna $\mathbf{1}_1$ displays a very strong directivity towards the upper side (the side on which the antenna element 16 is provided) particularly in the area directly above it. On the lower side of the antenna (the side on which the reflection conductor 14 is provided), the radiation directivity is extremely weak. This means that this monopole antenna $\mathbf{1}_1$ is suitable for example for halls and stairwells, where there is a large free overhead space, or for sending and receiving electromagnetic waves between a ground station and an airborne balloon. Since the antenna displays no directivity in the lateral direction, it is particularly suitable for radiation from the sky.

As is shown in FIG. 15(*b*), the monopole antenna $\mathbf{1}_2$ displays a very strong directivity towards the upper side (the side on which the antenna element 16 is provided). On the lower side of the antenna (the side on which the reflection conductor 14 is provided), the radiation directivity is extremely weak. Moreover, the antenna displays strong radiation directivity with respect to slant lateral directions on its upper side. This means that this monopole antenna $\mathbf{1}_2$ is suitable for rooms with normal lateral extension. In particular, since radiation without directivity with respect to lateral directions becomes possible, excellent radiation in spacious rooms can be attained by placing the antenna at the center of the room ceiling.

As is shown in FIG. 15(*c*), the conventional monopole antenna 1' displays larger radiation directivity with respect to the lower side of the antenna (the side on which no reflection conductor is provided) than the monopole antennas $\mathbf{1}_1$ and $\mathbf{1}_2$ of the present embodiment. In other words, the leakage of electromagnetic waves on the lower side of this monopole antenna 1' is comparatively large, so that it is not suitable for installation at a room ceiling.

As becomes clear from this, with the monopole antenna $\mathbf{1}_1$ and $\mathbf{1}_2$ that are equipped with a reflection conductor 14, the electromagnetic waves that are radiated on the lower side of the antenna are reflected by the reflection conductor 14, so that the radiation on the upper side of the antenna is strengthened.

Figure 16:
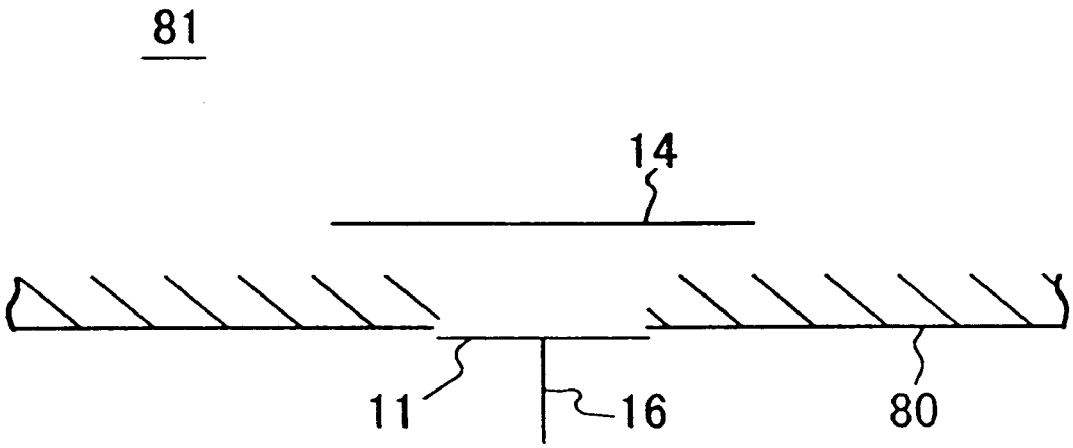
FIG. 16 shows an example of how the monopole antenna of the sixth embodiment of the present invention can be installed.

Furthermore, if the monopole antenna 1 of this embodiment is attached to a room ceiling, the reflection conductor 14 can be buried in an inner portion 81 of the ceiling 80, and the earth conductor 11 can be attached to the surface of the ceiling 80, so that only the antenna element 16 protrudes from the ceiling 80 towards the floor, as shown in FIG. 16, and the antenna hardly can be noticed if a linear conductor is used for the antenna element 16, so that its optical appearance will not be unpleasant.

Moreover, instead of the linear conductor serving as the antenna element 16, an antenna element can be used wherein the upper end of the linear conductor is connected perpendicularly to the center of a disk-shaped conductor, and the lower end of the linear conductor is connected to the current supply portion 12 located at the center of the earth conductor 11. If such a configuration is used, axial symmetry is preserved, and as with inverted-L antennas, the height of the antenna element can be reduced, so that the optical appearance becomes even more pleasant.

Thus, in accordance with the present embodiment, the radiation directivity of the monopole antenna 1 can be changed by using a reflection conductor 14. Moreover, by adjusting the size of the earth conductor 11, the reflection conductor 14, and the distance between the earth conductor 11 and the reflection conductor 14, the desired radiation directivity can be attained. Consequently, in accordance with this embodiment, a monopole antenna 1 having a simple configuration and desired directivity can be obtained, and by choosing an axially symmetric configuration, a monopole antenna 1 with uniform radiation directivity with respect to lateral directions of the antenna can be obtained.

When using the configuration of this embodiment, the input impedance can be stabilized by choosing at least ½ the wavelength at the resonance frequency of the antenna element 16 for the diameter of the earth conductor 11. This is explained in more detail in the following.

Usually, if in the monopole antenna 1 provided with the disk-shaped earth conductor 11 the diameter of the earth conductor 11 is smaller than ½ the wavelength at the resonance frequency of the antenna element 16, and current leaks to the outside from the outer coaxial conductor of the antenna input portion, which makes the input impedance unstable. By making the diameter of the earth conductor 11 of this embodiment at least ½ the wavelength at the resonance frequency of the antenna element 16, current leaks to the outside from the outer coaxial conductor of the antenna input portion can be avoided, and the input impedance can be stabilized, which stabilizes the transmission as well.

Seventh Embodiment

A seventh embodiment of the present invention is explained with reference to FIG. 17.

Figure 17:
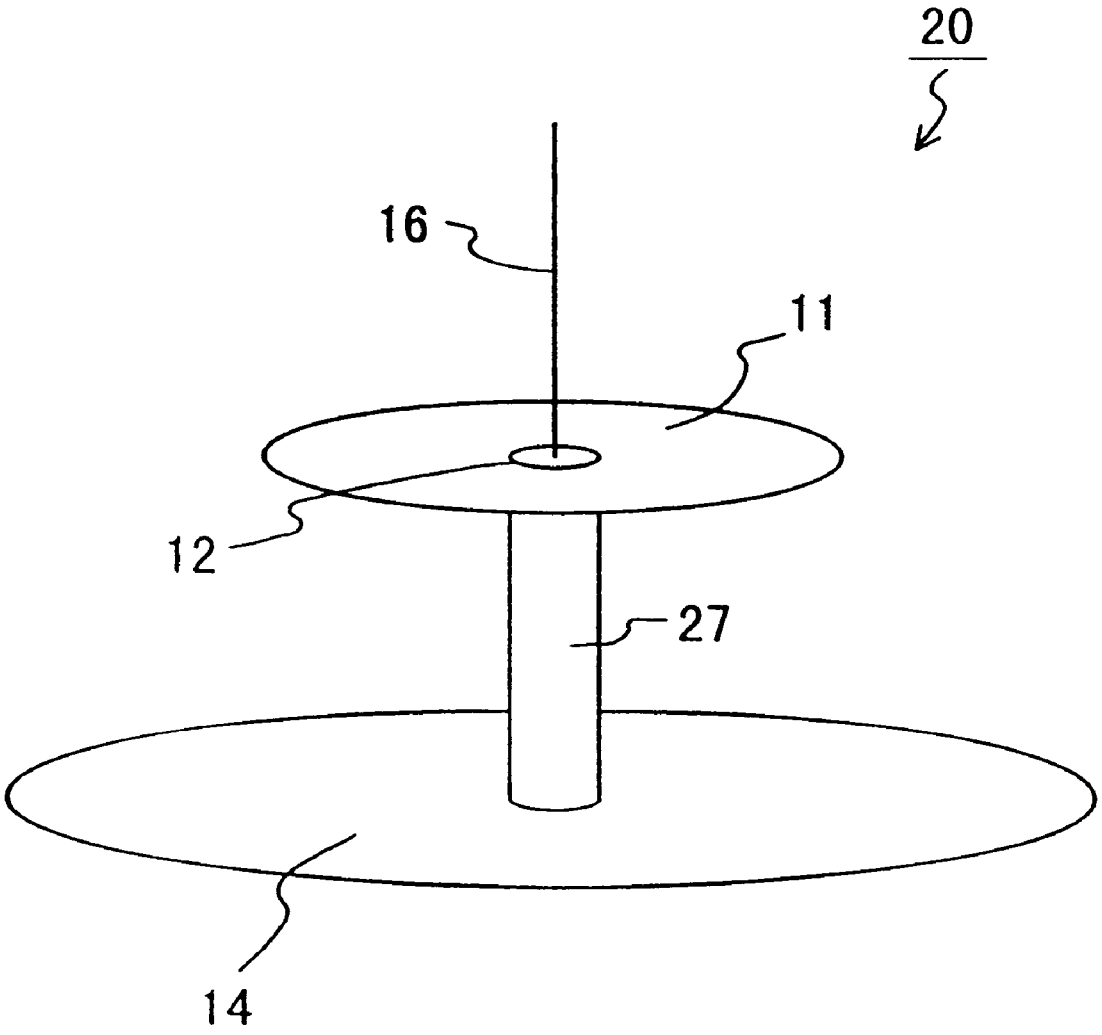
FIG. 17 is a schematic perspective view showing a monopole antenna of a seventh embodiment of the present invention.

FIG. 17 is a schematic perspective view showing a monopole antenna according to a seventh embodiment of the present invention. In FIG. 17, numeral 11 denotes an earth conductor, numeral 12 denotes a current supply portion, numeral 16 denotes an antenna element, numeral 14 denotes a reflection conductor, and numeral 27 denotes a connection conductor. Except for the connection conductor 27, this embodiment has the same configuration as the sixth embodiment, so that all parts besides the connection conductor 27 have been assigned the same numerals, and their further detailed explanation has been omitted here. The characteristic feature of the monopole antenna 20 of this embodiment is that the earth conductor 11 and the reflection conductor 14 are electrically connected by the connection conductor 27. There are several possible configurations for the connection of the earth conductor 11 and the reflection conductor 14, but in this embodiment the earth conductor 11 and the reflection conductor 14 are electrically connected by a columnar connection conductor 27 that is arranged perpendicularly to the center of the earth conductor 11 and the reflection conductor 14, which are both disk-shaped, thereby also providing a mechanical link between the two. Moreover, the diameter of the reflection conductor 14 is set to at least ½ the wavelength at the resonance frequency of the antenna element 16.

The following is an explanation of the operation of a monopole antenna having this configuration.

The monopole antenna 20 can be operated in the same manner as the monopole antenna 1 of the sixth embodiment, but in addition the following operation is also possible. If the monopole antenna 20 is installed in the ceiling of a room, the reflection conductor 14 can be buried in an inside portion 81 of the ceiling 80, as has been explained with reference to FIG. 16, but it cannot be avoided that the earth conductor 11 on the ceiling 80 is exposed towards the room side. Therefore, when it is desirable to make the earth conductor 11 as small as possible to hide it from sight, it occurs that the diameter of the disk-shaped earth conductor 11 becomes less than ½ the wavelength at the resonance frequency of the antenna element 16. However, with such a configuration, current leaks to the outside from the outer coaxial conductor of the antenna input portion, which invariably leads to an unstable input impedance.

On the other hand, with the present embodiment, the following configuration is possible.

Firstly, the reflection conductor 14 is electrically connected to the earth conductor 11. Therefore, the reflection conductor 14 does not only serve as a reflection conductor (that is, to control the radiation direction of the electromagnetic waves), but also fulfills electrically the same function as the earth conductor 11. Thus, while serving as a reflection conductor as before, the reflection conductor 14 also suppresses current leaks and therefore stabilizes the input impedance. Consequently, even when the diameter of the earth conductor 11 is set to a small diameter of less than ½ the wavelength at the resonance frequency of the antenna element 16, the input impedance becoming unstable due to current leaks can be avoided.

Secondly, the diameter of the reflection conductor 14 is set to at least ½ the wavelength at the resonance frequency of the antenna element 16. This suppresses current leaks even more rigidly, so that the input impedance can be stabilized even further.

Because of these reasons, even when the diameter of the earth conductor 11 is set to a diameter of less than ½ the wavelength at the resonance frequency of the antenna element 16, i.e. a value where the possibility of current leaks is comparatively high, the current leaks to be expected can be suppressed effectively. Consequently, by using this embodiment, miniaturization of the earth conductor 11 and stabilization of the input impedance can both be achieved.

When using the configuration of this embodiment, the reflection conductor 14 has a comparatively large diameter of at least ½ the wavelength at the resonance frequency of the antenna element 16, but if the monopole antenna 20 is attached to the ceiling of a room, the reflection conductor 14 is buried in the inner portion of the ceiling, so that the portion of the antenna that is exposed towards the inside of the room is not increased, even if the reflection conductor 14 becomes somewhat large.

Thus, the characteristic feature of the monopole antenna 20 of this embodiment is that it can achieve both stabilization of the input impedance and miniaturization, and another characteristic feature is that the structural stability of the antenna is enhanced by mechanically coupling the earth conductor 11 to the reflection conductor 14 with the connection conductor 27.

Thus, according to this embodiment, a monopole antenna with very simple structure and variable radiation directivity can be obtained, which has a stabler configuration with regard to its operation and structure.

This embodiment has been explained taking a monopole antenna 20 as an example, which is provided with a single earth conductor 11 and a single reflection conductor 14. However, the present invention is not limited to monopole antennas of this configuration, and it is also possible to provide the monopole antenna with a plurality of reflection conductors, and electrically connect all of these reflection conductors to the earth conductor 11 with connection conductors. It is also possible to provide a plurality of reflection conductors and selectively connect at least one of these reflection conductors electrically to the earth conductor 11 with a connection conductor.

The sixth and the seventh embodiment have been explained taking monopole antennas 20 as an example, which are provided with a single reflection conductor 14, and which have axial symmetry. However, the present invention is not limited to monopole antennas of this configuration, and it is also possible to adjust the shape and the size of the earth conductor 11, the number and the shape and size of the reflection conductor, and the position of the earth conductor and the reflection conductor(s), so as to realize a monopole antenna, that has the desired radiation directivity.

The sixth and the seventh embodiment have been explained taking monopole antennas 20 as an example, which are provided with an antenna element 16 including a linear conductor. However, the present invention is not limited to monopole antennas of this configuration, and it is also possible to connect the center of a disk-shaped conductor to the upper end of the linear conductor to form an antenna element, and set the sum of the length of the linear conductor and the radius of the disk-shaped conductor to the length of the antenna element 16. Thereby, the height of the monopole antenna can be reduced even further. Furthermore, if an antenna element 13 in accordance with the first to fifth embodiment is used (i.e. an antenna element comprising a linear conductor 21, a disk-shaped conductor 22, ring-shaped conductors 24 and 26, and anti-resonance circuits 23 and 25, or an antenna element comprising a linear conductor, a ring-shaped conductor, and an anti-resonant circuit), the effects of the above first to fifth embodiment are attained as well so that a monopole antenna with even better characteristics can be obtained.

Eighth embodiment

An eighth embodiment of the present invention is explained with reference to FIG. 18.

Figure 18:
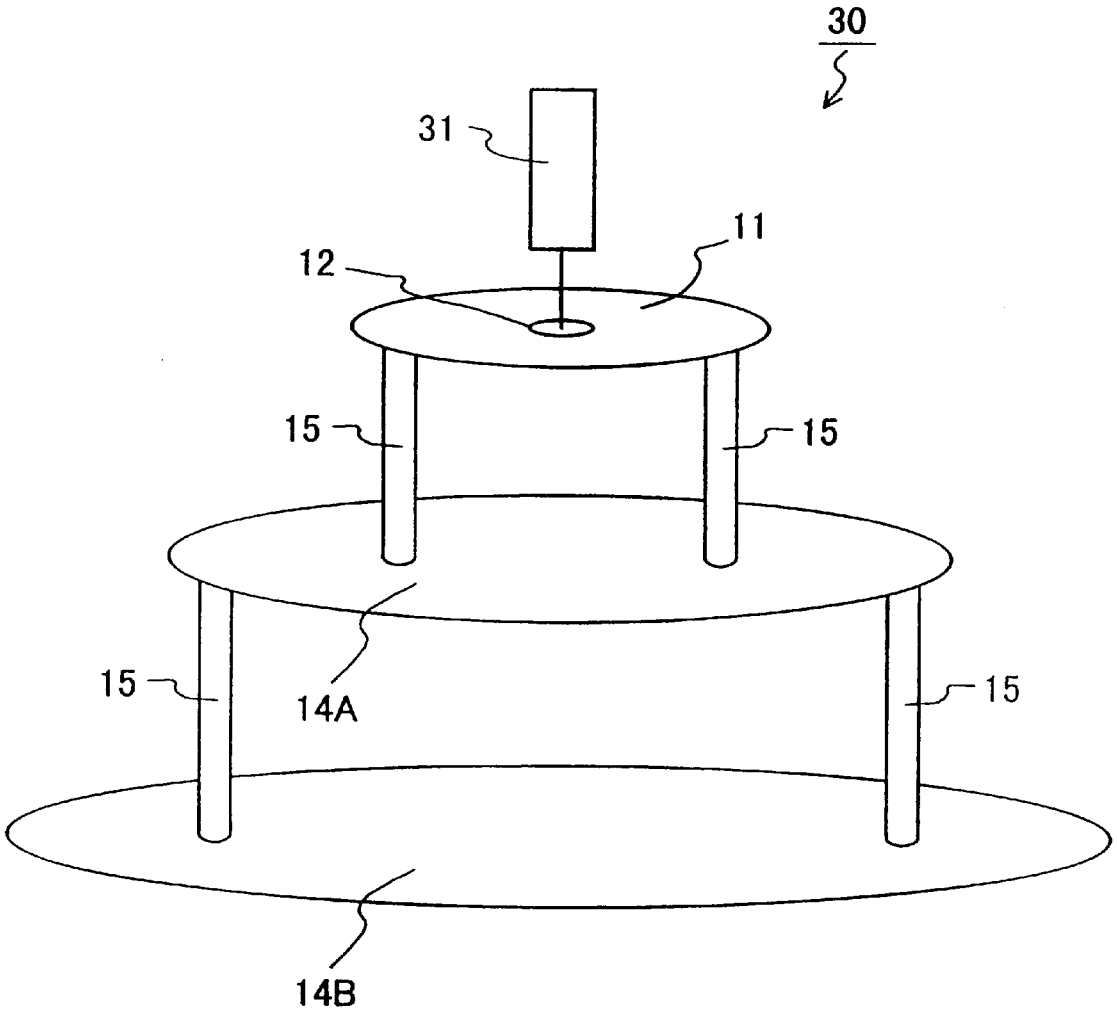
FIG. 18 is a schematic perspective view showing a monopole antenna of an eighth embodiment of the present invention.

FIG. 18 is a schematic perspective view showing a monopole antenna according to an eighth embodiment of the present invention. In FIG. 18, numeral 11 denotes an earth conductor, numeral 12 denotes a current supply portion, numeral 31 denotes an antenna element, and numerals 14A and 14B denote reflection conductors. Except for the reflection conductors 14A and 14B and the antenna element 31, this embodiment has the same configuration as the sixth embodiment, so that all parts besides the reflection conductors 14A and 14B and the antenna element 31 have been assigned the same numerals, and their further detailed explanation has been omitted here. The monopole antenna 30 of this embodiment is provided with an antenna element 31, which can be excited at a plurality of resonance frequencies (that is, it can be operated at a plurality of frequencies). The antenna element 31 is arranged perpendicularly to the earth conductor 11 and is electrically connected to current supply portion 12, which is located at the center of the earth conductor 11. The reflection conductors 14A and 14B are disk-shaped and arranged in parallel to each other and to the earth conductor 11. Moreover, the reflection conductors 14A and 14B are arranged coaxially with respect to the earth conductor 11. The earth conductor 11, the reflection conductor 14A and the reflection conductor 14B are connected by supporting rods 15 made of for example, an insulator, or a dielectric material such as Teflon (polytetrafluoroethylene) or glass epoxy.

Moreover, in the monopole antenna 30 of this embodiment, the antenna element 31 can be excited at two resonance frequencies, and is accordingly provided with two reflection conductors (reflection conductors 14A and 14B) corresponding to the two resonance frequencies, while maintaining axial symmetry.

The following is an explanation of a monopole antenna with such a configuration.

The operation of the monopole antenna 30 is basically the same as the operation of the monopole antenna 1 of the sixth embodiment. However in this monopole antenna 30, the antenna element 31 can be excited at the two resonance frequencies $f_0$ and $f_1$. In this case, the size of the earth conductor 11 and the reflection conductors 14A and 14B varies in accordance with the resonance frequencies, and so does the radiation directivity. Therefore, by adjusting the shapes and the sizes of the earth conductor 11, and the reflection conductors 14A and 14B, and the distance between the earth conductor 11 and the reflection conductors 14A and 14B in accordance with the resonance frequencies $f_0$ and $f_1$, the desired radiation directivity can be attained for each of the resonance frequencies $f_0$ and $f_1$.

Furthermore, as in the sixth embodiment, the input impedance of this monopole antenna 30 can be stabilized by making the diameter of the earth conductor 11 of this embodiment at least ½ the wavelength at the lower of the resonance frequencies of the antenna element 31.

Ninth Embodiment

A ninth embodiment of the present invention is explained with reference to FIG. 19.

Figure 19:
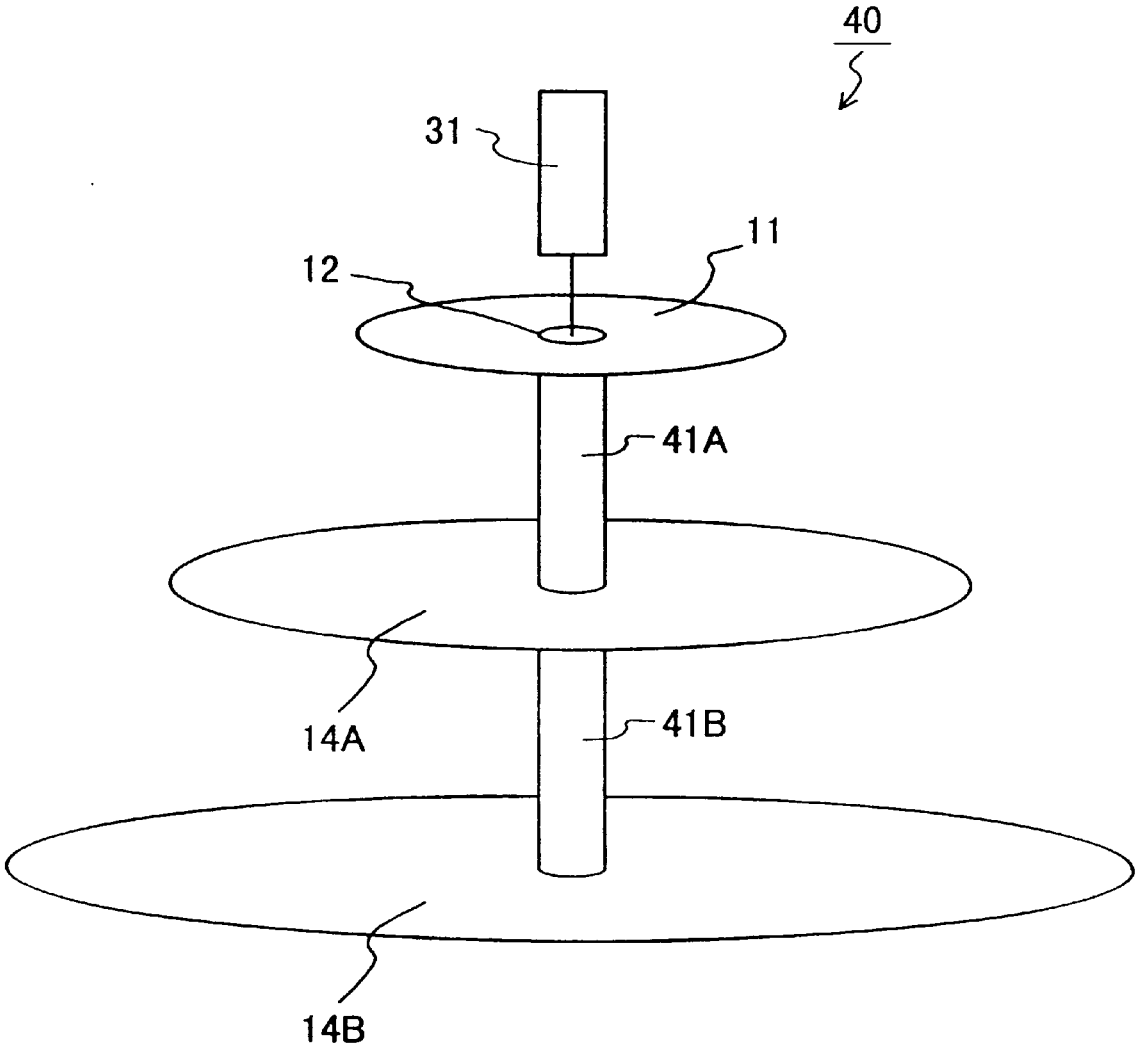
FIG. 19 is a schematic perspective view showing a monopole antenna of a ninth embodiment of the present invention.
Figure 20:
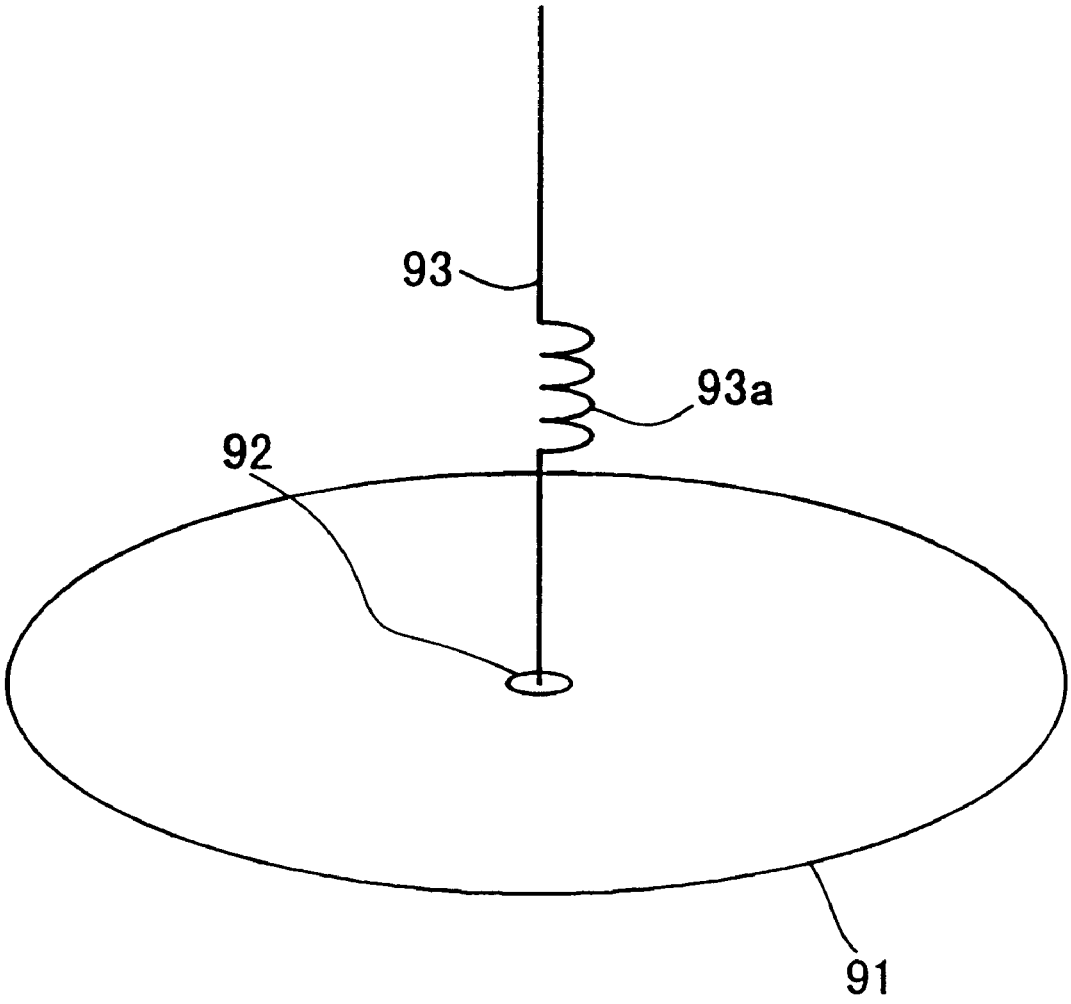
FIG. 20 PRIOR ART
FIG. 20 is a schematic perspective view showing a conventional monopole antenna.

FIG. 19 is a schematic perspective view showing a monopole antenna according to an ninth embodiment of the present invention. In FIG. 19, numeral 11 denotes an earth conductor, numeral 12 denotes a current supply portion, numeral 31 denotes an antenna element, numerals 14A and 14B denote reflection conductors, and numerals 41A and 41B denote connection conductors. Except for the connection conductors 41A and 41B, this embodiment has the same configuration as the eighth embodiment, so that all parts besides the connection conductors 41A and 41B have been assigned the same numerals as in the eighth embodiment, and their further detailed explanation has been omitted here. The characteristic feature of the monopole antenna 40 of this embodiment is that the earth conductor 11 and the reflection conductor 14A are electrically connected by the connection conductor 41A, and the reflection conductor 14A and the reflection conductor 14B are electrically connected by the connection conductor 41B. There are several possible configurations for the connection of the earth conductor 11 and the reflection conductor 14A, or for the connection of the reflection conductor 14A and the reflection conductor 14B, but in this embodiment the earth conductor 11 and the reflection conductor 14A are electrically connected by a columnar connection conductor 41A that is arranged perpendicularly at the center of the earth conductor 11 and the reflection conductor 14, which are both disk-shaped, thereby providing not only an electrical, but also a mechanical link between the two. Similarly, the reflection conductor 14A and the reflection conductor 14B are electrically connected by a columnar connection conductor 41B that is arranged perpendicularly at the center of the reflection conductor 14A and the reflection conductor 14B, which are both disk-shaped, thereby providing not only an electrical, but also a mechanical link between the two. Moreover, the diameter of the larger one of the reflection conductors 14A and 14B (in FIG. 19, this is the reflection conductor 14A near the earth conductor 11) is set to at least ½ the wavelength at the lower resonance frequency of the antenna element 31.

The following is an explanation of a monopole antenna with such a configuration.

The operation of the monopole antenna 40 is basically the same as the operation of the monopole antenna 1 of the sixth embodiment. However in this monopole antenna 40, the antenna element 41 can be excited at the two resonance frequencies $f_0$ and $f_1$. In this case, the size of the earth conductor 11 and the reflection conductors 14A and 14B varies in accordance with the resonance frequencies, and so does the radiation directivity. Therefore, by adjusting the shapes and the sizes of the earth conductor 11, and the reflection conductors 14A and 14B, and the distance between the earth conductor 11 and the reflection conductors 14A and 14B in accordance with the resonance frequencies $f_0$ and $f_1$, the desired radiation directivity can be attained for each of the resonance frequencies $f_0$ and $f_1$.

In the monopole antenna 40 of this embodiment, the reflection conductors 14A and 14B are electrically connected to the earth conductor 11 via the connection conductors 41A and 41B, and the diameter of the larger one of the reflection conductors 14A and 14B (in FIG. 19, this is the reflection conductor 14B near the earth conductor 11) is set to at least ½ the wavelength at the lower resonance frequency of the antenna element 31. Therefore, even when the diameter of the earth conductor 11 is set to a diameter of less than ½ the wavelength at the lower resonance frequency of the antenna element 31, i.e. a value where the possibility of current leaks is comparatively high, the current leaks to be expected can be suppressed effectively. Consequently, by using this embodiment, the miniaturization of the earth conductor 11 and stabilization of the input impedance can both be achieved. The reason why these effects can be attained are the same as explained for the seventh embodiment, and are thus omitted here.

Furthermore, the structural stability of the antenna of this embodiment is enhanced by mechanically coupling the earth conductor 11 to the reflection conductor 14A with the connection conductor 41A, and by mechanically coupling the reflection conductor 14A to the reflection conductor 14B with the connection conductor 41B.

Thus, according to this embodiment, a monopole antenna with a simple structure and variable radiation directivity can be obtained, which has a stabler configuration with regard to its operation and structure.

This embodiment has been explained taking a monopole antenna 40 as an example, which is provided with two reflection conductors 14A, 14B and two connection conductors 41A, 41B. However, the present invention is not limited to monopole antennas of this configuration, and it is also possible to provide the monopole antenna with three or more reflection conductors, and electrically connect all of these reflection conductors to the earth conductor 11 with connection conductors. It is also possible to provide three or more reflection conductors and selectively connect at least one of these reflection conductors electrically to the earth conductor 11 with a connection conductor.

The eighth and the ninth embodiment have been explained taking monopole antennas as an example, which are provided with an antenna element 31 that can be excited at two resonance frequencies $f_0$ and $f_1$, and which accordingly is provided with two reflection conductors (reflection conductors 14A and 14B) corresponding to the two resonance frequencies, while maintaining axial symmetry. However, the present invention is not limited to monopole antennas of this configuration, and it is also possible to use only one reflection conductor. Also in this case, the desired radiation directivity can be attained by adjusting the shape and the size of the earth conductor 11 and the reflection conductor, and the distance between the earth conductor 11 and the reflection conductor. Moreover, it is also possible to change the radiation directivity at each resonance frequency by combining a plurality of reflection conductors. For example, the desired radiation directivities at the various resonance frequencies can be attained by adjusting the number of the reflection conductors and their shapes and sizes.

Furthermore, if in the above-noted eighth or ninth embodiment, an antenna element 13 in accordance with the first to fifth embodiment is used (i.e. an antenna element comprising a linear conductor 21, a disk-shaped conductor 22, ring-shaped conductors 24 and 26, and anti-resonance circuits 23 and 25, or an antenna element comprising a linear conductor, a ring-shaped conductor, and an anti-resonant circuit) instead of the (multi-frequency) antenna element 31 that can be excited at a plurality of resonance frequencies, the effects of the above first to fifth embodiment are attained as well so that a monopole antenna with even better characteristics can be obtained.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A monopole antenna comprising an earth conductor;

a current supply portion located on a surface of said earth conductor;

a linear conductor having a first end connected to said current supply portion, and a second end;

a planar conductor that is connected to the second end of said linear conductor; and a ring-shaped conductor whose inner edge is connected to an outer edge of said planar conductor via an anti-resonance circuit.

2. The monopole antenna of claim 1, further comprising an earth wire that connects at least one of said planar conductor and said ring-shaped conductor to said earth conductor.

3. The monopole antenna of claim 1, wherein said planar conductor and said ring-shape conductor are arranged in one plane.

4. The monopole antenna of claim 1, wherein said planar conductor and said ring-shape conductor are arranged in different planes.

5. The monopole antenna of claim 1, wherein said ring-shape conductor comprises a plurality of ring-shaped conductors, and opposing inner edges and outer edges of adjacent ring-shaped conductors are connected via an anti-resonance circuit.

6. The monopole antenna of claim 5, further comprising an earth wire that connects at least one of said planar conductor and said plurality of ring-shaped conductors to said earth conductor.

7. The monopole antenna of claim 5, wherein said planar conductor and said plurality of ring-shape conductors are arranged in one plane.

8. The monopole antenna of claim 5, wherein said planar conductor and at least one of said plurality of ring-shape conductors are arranged in different planes.

9. The monopole antenna of claim 1, wherein said planar conductor is a disk-shaped conductor.

10. The monopole antenna of claim 9, wherein said current supply portion is arranged at the center of the surface of said earth conductor, the first end of said linear conductor is connected to said current supply portion so that said linear conductor is perpendicular to said earth conductor, the second end of the linear conductor is connected to the center of said planar conductor so that said linear conductor is perpendicular to said planar conductor, and said ring-shape conductor is arranged concentrically around said planar conductor.

11. The monopole antenna of claim 1, wherein said anti-resonance circuit is a parallel circuit comprising a coil and a capacitor.

12. The monopole antenna of claim 1, wherein said anti-resonance circuit consists of a coil.

13. The monopole antenna of claim 1, wherein the planar conductor, the anti-resonance circuit, and the ring-shaped conductor are patterned on a dielectric substrate.

14. The monopole antenna of claim 1, further comprising a reflection conductor which is arranged on a side of said earth conductor that is opposite the side on which said planar conductor is arranged, in a manner that the reflection conductor is electrically coupled to said earth conductor through a space between the two.

15. The monopole antenna of claim 14, wherein said reflection conductor is electrically connected to said earth conductor.

16. The monopole antenna of claim 14, wherein said reflection conductor comprises a plurality of reflection conductors, and at least one of the plurality of reflection conductors is electrically connected to said earth conductor.

17. The monopole antenna of claim 14, wherein said earth conductor and said reflection conductor have surfaces that face each other, and a surface area of said reflection conductor is greater than a surface area of said earth conductor.

18. A monopole antenna comprising an earth conductor;

a current supply portion located on a surface of said earth conductor;

a linear conductor having a first end connected to said current supply portion, and a second end; and a ring-shaped conductor whose inner edge is connected to the second end of said linear conductor via an anti-resonance circuit.

19. The monopole antenna of claim 18, further comprising an earth wire that connects said ring-shaped conductor to said earth conductor.

20. The monopole antenna of claim 18, wherein said ring-shape conductor comprises a plurality of ring-shaped conductors, and opposing inner edges and outer edges of adjacent ring-shaped conductors are connected via an anti-resonance circuit.

21. The monopole antenna of claim 20, further comprising an earth wire that connects at least one of said plurality of ring-shaped conductors to said earth conductor.

22. The monopole antenna of claim 20, wherein said plurality of ring-shape conductors are arranged in one plane.

23. The monopole antenna of claim 20, wherein at least one of said plurality of ring-shape conductors is arranged in a different plane.

24. The monopole antenna of claim 20, wherein said current supply portion is located at a center of the surface of said earth conductor, and the plurality of ring-shaped conductors is arranged concentrically around said current supply portion.

25. The monopole antenna of claim 18, wherein said anti-resonance circuit is a parallel circuit comprising a coil and a capacitor.

26. The monopole antenna of claim 18, wherein said anti-resonance circuit consists of a coil.

27. The monopole antenna of claim 18, wherein the anti-resonance circuit and the ring-shaped conductor are patterned on a dielectric substrate.

28. The monopole antenna of claim 18, further comprising a reflection conductor which is arranged on a side of said earth conductor that is opposite the side on which a ring-shaped conductor is arranged, in a manner that the reflection conductor is electrically coupled to said earth conductor through a space between the two.

29. The monopole antenna of claim 28, wherein said reflection conductor is electrically connected to said earth conductor.

30. The monopole antenna of claim 28, wherein said reflection conductor comprises a plurality of reflection conductors, and at least one of the plurality of reflection conductors is electrically connected to said earth conductor.

31. The monopole antenna of claim 28, wherein said earth conductor and said reflection conductor have surfaces that face each other, and a surface area of said reflection conductor is greater than a surface area of said earth conductor.

* * * * *